US008821104B2

(12) United States Patent
Yasuda et al.

(10) Patent No.: US 8,821,104 B2
(45) Date of Patent: Sep. 2, 2014

(54) LOADER WORK MACHINE

(75) Inventors: Toyoaki Yasuda, Osaka (JP); Masanori Fujino, Sakai (JP); Toshihiko Takemura, Izumi (JP); Yasuo Nakata, Sakai (JP); Yoshitaka Matsubara, Osaka (JP); Yoshihiro Ueda, Sakai (JP); Yuuki Takano, Sakai (JP); Yusuke Kawai, Sakai (JP); Ryohei Sumiyoshi, Sakai (JP); Hiroyuki Anami, Kaizuka (JP); Naoya Muramoto, Sakai (JP); Kenji Mitsui, Sakai (JP); Youhei Kawano, Sakai (JP); Takeshi Ikumura, Sakai (JP)

(73) Assignee: Kubota Corporation, Osaka (JP)

( * ) Notice: Subject to any disclaimer, the term of this patent is extended or adjusted under 35 U.S.C. 154(b) by 868 days.

(21) Appl. No.: 12/922,921

(22) PCT Filed: Mar. 26, 2009

(86) PCT No.: PCT/JP2009/056166

§ 371 (c)(1),
(2), (4) Date: Dec. 8, 2010

(87) PCT Pub. No.: WO2009/157238

PCT Pub. Date: Dec. 30, 2009

(65) Prior Publication Data

US 2011/0091307 A1 Apr. 21, 2011

(30) Foreign Application Priority Data

| | | |
|---|---|---|
| Jun. 26, 2008 | (JP) | 2008-167356 |
| Jul. 22, 2008 | (JP) | 2008-188670 |
| Sep. 3, 2008 | (JP) | 2008-226305 |
| Sep. 3, 2008 | (JP) | 2008-226306 |
| Sep. 3, 2008 | (JP) | 2008-226307 |
| Sep. 3, 2008 | (JP) | 2008-226308 |
| Sep. 3, 2008 | (JP) | 2008-226309 |
| Sep. 5, 2008 | (JP) | 2008-228360 |
| Sep. 12, 2008 | (JP) | 2008-234103 |

(51) Int. Cl.

| | |
|---|---|
| ***E02F 3/34*** | (2006.01) |
| ***E02F 9/16*** | (2006.01) |
| ***E02F 9/22*** | (2006.01) |
| ***E02F 3/43*** | (2006.01) |
| ***E02F 9/08*** | (2006.01) |

(52) U.S. Cl.

CPC ..... *E02F 3/3405* (2013.01); *E02F 3/3414* (2013.01); *E02F 9/2275* (2013.01); *E02F 3/432* (2013.01); *E02F 9/0816* (2013.01); *Y10S 414/131* (2013.01)

USPC ..... 414/685; 414/680; 414/722; 414/918; 248/49; 59/78.1

(58) Field of Classification Search

USPC ..... 414/680, 685, 722, 918; 248/49; 59/78.1

See application file for complete search history.

(56) References Cited

U.S. PATENT DOCUMENTS 5,547,244 A * 8/1996 Lee ..... 296/102
6,065,276 A 5/2000 Hohnl et al.

(Continued)

FOREIGN PATENT DOCUMENTS

JP 2006307498 A 11/2006
JP 2008062771 A 3/2008
WO 0227107 A1 4/2002

*Primary Examiner* — Scott Lowe

(74) *Attorney, Agent, or Firm* — The Webb Law Firm

(57) ABSTRACT

A loader work machine is disclosed in which a base portion of each of right/left arms (77) is received by an arm support portion (164) of a first lift link (81) and pivotally supported by a first arm shaft (88), and a hydraulic pipe arrangement (167) connected to a hydraulic actuator (98) extend through an support frame (11) from inside to outside of its inner wall (12), and toward an arm (77). The base portion of the arm (77) is supported to the arm support portion (164) at a position adjacent a link outer wall (157) in a transverse direction so that a hose accommodation space (165) is formed between a link inner wall (156) and an internal side face of the base portion of the arm (77). The hydraulic pipe arrangement (167) runs frontward of the first arm shaft (88) and a first link shaft (85), and is disposed in the hose accommodation space (165).

17 Claims, 23 Drawing Sheets

(56) References Cited

U.S. PATENT DOCUMENTS

| | | | | |
|---|---|---|---|---|
| 6,098,739 | A | 8/2000 | Anderson et al. | |
| 6,205,665 | B1 | 3/2001 | Anderson et al. | |
| 6,283,220 | B1 * | 9/2001 | Carter | 169/24 |
| 6,684,537 | B2 * | 2/2004 | Ichikawa et al. | 37/347 |
| 8,303,026 | B2 * | 11/2012 | Yamashita et al. | 296/190.1 |
| 2004/0028514 | A1 | 2/2004 | Mimuro | |

* cited by examiner

LOADER WORK MACHINE

TECHNICAL FIELD

The present invention relates to a loader work machine.

BACKGROUND ART

Conventionally, in a loader work machine, a pair of, right/left arms are provided on right/left sides of a body frame. A working implement is attached to tip end portions of the right/left arms, and hydraulic actuators are provided for actuating the working implement. Base portions of a pair of the right/left arms are supported on a rear portion of the body frame, swingably in a vertical direction by a rear pair of right/left first lift links and a forward pair of right/left second lift links so that the tip end portions of the right/left arms are lifted and lowered frontward of the body frame (see Patent Documents 1 and 2, for example).

In the conventional loader work machine of this type, a hydraulic pipe arrangement connected to the hydraulic actuators extends from a body frame side to an arm side. The hydraulic pipe arrangement includes hydraulic hoses or the like, and in general each hose is disposed on an internal side in a transverse direction of each of right/left first lift links, in an exposed manner.

Patent Document 1: U.S. Pat. No. 6,205,665 B1

Patent Document 2: U.S. Pat. No. 6,098,739

DISCLOSURE OF THE INVENTION

In the conventional technique, a large portion of the hydraulic pipe arrangement connected to the hydraulic actuators for actuating the working implement on the arm tip end side is exposed outside, and thus problems arise that the hydraulic pipe arrangement, such as a hydraulic hose arrangement, is likely to be damaged, and the presence of the hydraulic pipe arrangement deteriorates an appearance of a rear portion of the loader work machine. In addition, nothing restricts the movement of the hydraulic pipe arrangement, and thus numerous clamps are required for fixing the hydraulic pipe arrangement.

In view of the above, an object of the present invention is to provide a loader work machine, in which the hydraulic pipe arrangement disposed from the body frame side to the arm side is not likely to be damaged, the appearance of the rear portion of the loader work machine is prevented from being deteriorated which may otherwise be caused by exposed hydraulic pipe arrangement, and the number of clamps required for fixing the hydraulic pipe arrangement can be reduced.

The above object is fulfilled by a first aspect of a loader work machine according to the present invention as under:—

A loader work machine comprising:

a body frame including a frame main body having a bottom wall, a pair of right/left side walls and a front wall; and a pair of right/left support frame provided on rear end portions of the frame main body, each of the support frame having an inner wall and an outer wall;

a cabin mounted on the body frame;

a pair of right/left traveling devices supporting the body frame;

a pair of right/left arms disposed on right/left lateral sides of the body frame and cabin;

a working implement attached between tip end portions of the right/left arms;

hydraulic actuators provided on the tip end portions of the right/left arms and configured to actuate the working implement;

a pair of right/left first lift links provided at rear portions of the body frame for supporting base portions of the respective arms swingably in a vertical direction, each of the lift links including a link outer wall, a link inner wall, a link connection wall connecting the link outer wall and link inner wall, and an arm support portion provided at an upper free end portion thereof by opening a front side thereof between the link inner wall and the link outer wall;

a pair of right/left second lift links provided at rear portions of the body frame more frontward than the first lift links for supporting the base portions of the respective arms swingably in the vertical direction;

a pair of right/left arm cylinders extending between the base portions of the respective arms and the rear portions of the body frame for lifting and lowering the respective arms;

a first link shaft provided between the inner wall and outer wall of the support frame associated therewith for pivotally supporting a lower base portion of the first lift link associated therewith: and a first arm shaft pivotally supporting the base portion of the arm associated therewith and received by the arm support portion, wherein a tip end side of the arm is lifted and lowered frontward of the body frame, wherein the base portion of the arm is supported by the arm support portion at a position adjacent the link outer wall in a transverse direction, to form a hose accommodation space by the link inner wall and an internal side face of the base portion of the arm, and wherein a hydraulic pipe arrangement extends toward the arm to be connected to the hydraulic actuator, the hydraulic pipe arrangement extending through from inside to outside of the inner wall and running frontward of the first arm shaft and first link shaft to be disposed in the hose accommodation space.

According to this configuration, the base portion of the right/left arms is supported by the arm support portion of the right/left first lift link at a position adjacent the link outer wall in a transverse direction, so that a hose accommodation space is formed between the link inner wall of the first lift link and the internal side face of the base portion of the arm. The hydraulic pipe arrangement runs frontward of the first arm shaft and the first link shaft, and is disposed in the hose accommodation space. Therefore, the hydraulic pipe arrangement can be protected between the link outer wall and the link inner wall. As a result, a portion of the hydraulic pipe arrangement exposed outside is reduced, and the hydraulic pipe arrangement disposed from the body frame side to the arm side is not likely to be damaged. In addition, since the hydraulic pipe arrangement is covered between link outer wall and link inner wall, the appearance of the rear portion of the loader work machine can be prevented from being deteriorated, which may otherwise be caused by the hydraulic pipe arrangement. Further, since the movement of the hydraulic pipe arrangement can be restricted between the link outer wall and the link inner wall, a number of the clamps for fixing the hydraulic pipe arrangement can be reduced. Since the hose accommodation space is provided, interference or friction between the hydraulic pipe arrangement and the base portion of the arm can be prevented, and the hydraulic pipe arrangement can be easily and securely disposed in a vertical direction in the first lift link.

In a second aspect of the loader work machine according to the present invention, an upper portion of the hydraulic pipe arrangement is disposed along an inner face of the link inner wall, and extends along the internal side face of the arm from an upper end of the first lift link.

In a third aspect of the loader work machine according to the present invention, the upper free end portion of the first lift link is made wider in the transverse direction so as to bulge laterally outward of the lower base portion of the first lift link, and the base portion of the arm is disposed offset laterally outward from a base portion of the first lift link.

In a fourth aspect of the loader work machine according to the present invention, at least the upper portion of the hydraulic pipe arrangement is formed of a flexible hydraulic hose portion, a front projection is provided at an upper end portion of the link inner wall and protrudes frontward therefrom for restricting lateral sway of the hydraulic hose portion, and a clamp is provided on the inner face of the link inner wall forming the hose accommodation space, the clamp being configured to fix the hydraulic hose portion.

In a fifth aspect of the loader work machine according to the present invention, the inner wall and the outer wall are disposed laterally outward of the side wall associated therewith.

In a sixth aspect of the loader work machine according to the present invention, the loader work machine further comprises a pair of right/left mounting plates, each of the mounting plates including an inner side portion fixed to a rear upper end of the side wall associated therewith, and an outer side portion protruding laterally outward from the side wall;

wherein a front lower end of the inner wall and a front lower end of the outer wall are fixed to an upper face of the outer side portion of the mounting plate.

In a seventh aspect of the loader work machine according to the present invention, a transverse width of the cabin is larger than a spacing distance between the right/left side walls.

In an eighth aspect of the loader work machine according to the present invention, an intermediate portion on a front end side of the arm is bent inward in the transverse direction so that a transverse width between front end portions of the right/left arms becomes smaller than a transverse width between rear portions of the right/left arms, and a whole length of the arm is disposed inward of an outer end and outward of an inner end of the traveling device associated therewith.

In a ninth aspect of the loader work machine according to the present invention, each of the right/left side wall has a bent rim portion provided at an upper end thereof, the bent rim portion protruding laterally outward, the rear upper end of the side wall being gradually inclined downward as it extends rearward;

a front end portion of the mounting plate is fixed to a rear end portion of the bent rim portion, and the mounting plate is attached to the rear upper end of the side wall so that the mounting plate and the side wall form a T-shape or L-shape, and the outer side portion of the mounting plate protrudes laterally outward from the upper end of the side wall so that the bent rim portion of the side wall and the mounting plate form a fender for covering an upper side and a rear side of the traveling device associated therewith.

In a tenth aspect of the loader work machine according to the present invention, the front wall has a bent rim portion at an upper end thereof, the bent rim portion protruding rearward, right/left connecting pieces extending laterally outward from opposite lateral sides of the bent rim portion, and each of the right/left connecting pieces is fixed to a front end of the bent rim portion of the side wall associated therewith.

In an eleventh aspect of the loader work machine according to the present invention, the loader work machine further comprises a transversal connecting member connecting upper portions of the right/left inner walls, wherein the transversal connecting member includes a front wall plate, and an upper wall plate protruding rearward from an upper end of the front wall plate, a rear portion of the upper wall plate being inclined downward and rearward.

In a twelfth aspect of the loader work machine according to the present invention, the loader work machine further comprises:

a connection reinforcing plate which is fixed to a rear end portion of the bottom wall along a rear end of the bottom wall and connected and fixed to lower ends of the right/left support frames; and a lower connection plate which is fixed to a rear end portion of the connection reinforcing plate along a rear end of the connection reinforcing plate and connected and fixed to the lower ends of the right/left support frames.

In a thirteenth aspect of the loader work machine according to the present invention, each of the right/left traveling devices includes a track frame which is a component separate from the body frame and is fixed to the side wall associated therewith.

In a fourteenth aspect of the loader work machine according to the present invention, each of the right/left reinforcing plates is fixed to an inner face of the side wall associated therewith at a position corresponding to a position for fixing the track frame.

In a fifteenth aspect of the loader work machine according to the present invention, each of the right/left reinforcing plates includes a standing wall overlapping with the inner face of the side wall and a lower wall overlapping with an upper face of the bottom wall, the standing wall and the lower wall together forming an L-shape, and the lower walls of the right/left reinforcing plates are spaced apart in the transverse direction.

In a sixteenth aspect of the loader work machine according to the present invention, a front end portion and a rear end portion of the track frame are fixed to an outer face of the side wall, and a front reinforcing plate and a rear reinforcing plate are fixed to the inner face of the side wall at positions corresponding to positions of the front end portion and rear end portion of the fixed track frame, respectively.

In a seventeenth aspect of the loader work machine according to the present invention, the cabin includes a pair of right/left side wall bodies, a back wall body closing a back side of the cabin and a bottom wall body connecting lower end portions of the right/left side wall bodies, the cabin is swingably supported on the body frame so as to be switchable between a mount state in which a bottom side of the cabin is placed on the body frame, and a tilted state in which the bottom side of the cabin is spaced apart upward from the body frame, a partition plate is provided for separating the frame main body into a front portion and a rear portion of the body frame, and a driver's seat is provided on the bottom wall body frontward of the back wall body, and when the cabin is brought to the mount state, the bottom wall body comes into contact with an upper side of the partition plate, portions frontward of the back wall body and the front portion of the body frame are shielded from the rear portion of the body frame on which an engine is mounted, by the partition plate, bottom wall body and back wall body.

Also, the above object is fulfilled by a first aspect of a method of manufacturing a loader work machine according to the present invention as under:—

A method of manufacturing a loader work machine, the loader work machine comprising: a body frame mounting a cabin thereon; a pair of right/left arms having base portions thereof supported swingably in a vertical direction at a rear portion of the body frame so that tip ends of the right/left arms may be lifted and lowered frontward of the body frame; and a pair of right/left arm cylinders each disposed between the base portion of the associated arm and the rear portion of the body frame for lifting and lowering the arm, the method comprising the steps of:

forming a frame main body of the body frame having a bottom wall, a pair of right/left side walls and a front wall;

forming a pair of right/left support frames each having an inner wall, an outer wall and a frame connecting wall connecting the inner wall and the outer wall;

fixing by welding a mounting plate to a rear upper end of each of the side walls, and fixing by welding a front lower end of the inner wall and a front lower end of the outer wall to an upper face of the mounting plate, to connect and fix the right/left support frames to a rear end side of the frame main body and form the body frame, supporting the base portions of the arms swingably in the vertical direction by the respective support frames, and connecting lower base portions of the arm cylinders swingably to the respective support frames.

In a second aspect of the method of manufacturing a loader work machine according to the present invention, the method further comprises the steps of:

providing each of the right/left side walls with a bent rim portion at an upper end thereof, the bent rim portion protruding laterally outward, the rear upper end of the side wall being gradually inclined downward as it extends rearward;

overlapping and fixing by welding a front end portion of the mounting plate with a rear end portion of the bent rim portion of the side wall associated therewith, and fixing by welding the mounting plate to the rear upper end of the side wall so that the mounting plate and the side wall form a T-shape or L-shape; and protruding an outer side portion of the mounting plate laterally outward of the upper end of the side wall so that the bent rim portion of the side wall and the mounting plate form a fender for covering an upper side and a rear side of a right/left traveling device.

In a third aspect of the method of manufacturing a loader work machine according to the present invention, the method further comprises the steps of:

providing the front wall with a further bent rim portion at an upper end thereof, the further bent rim portion protruding rearward and having right/left connecting pieces extending laterally outward on opposite lateral sides thereof; and welding each of the right/left connecting pieces to a front end of the bent rim portion of the side wall associated therewith.

In a fourth aspect of the method of manufacturing a loader work machine according to the present invention, the method further comprises the steps of:

fixing by welding a connection reinforcing plate to a rear end portion of the bottom wall along a rear end of the bottom wall, and connecting and fixing by welding the connection reinforcing plate to lower ends of the right/left support frames; and fixing by welding a lower connection plate to a rear end portion of the connection reinforcing plate along a rear end of the connection reinforcing plate, and connecting and fixing by welding the lower connection plate to the lower ends of the right/left support frames.

In a fifth aspect of the method of manufacturing a loader work machine according to the present invention, the method further comprises the steps of:

providing a track frame of each of the right/left traveling devices separately from the body frame, and fixing the track frame to the side wall associated therewith by a fastener such as a bolt.

In a sixth aspect of the method of manufacturing a loader work machine according to the present invention, the method further comprises the step of:

providing a track frame of each of the right/left traveling devices separately from the body frame, and fixing the track frame to the side wall associated therewith by welding.

In a seventh aspect of the method of manufacturing a loader work machine according to the present invention, the method further comprises the step of:

overlapping and fixing by welding each of right/left reinforcing plates to an inner face of the corresponding side wall at a position corresponding to a position for fixing the track frame.

BEST MODE FOR CARRYING OUT THE INVENTION (Entire Configuration)

An embodiment of a loader work machine to which the present invention is applied will be described hereinafter with reference to the drawings.

Figure 1:
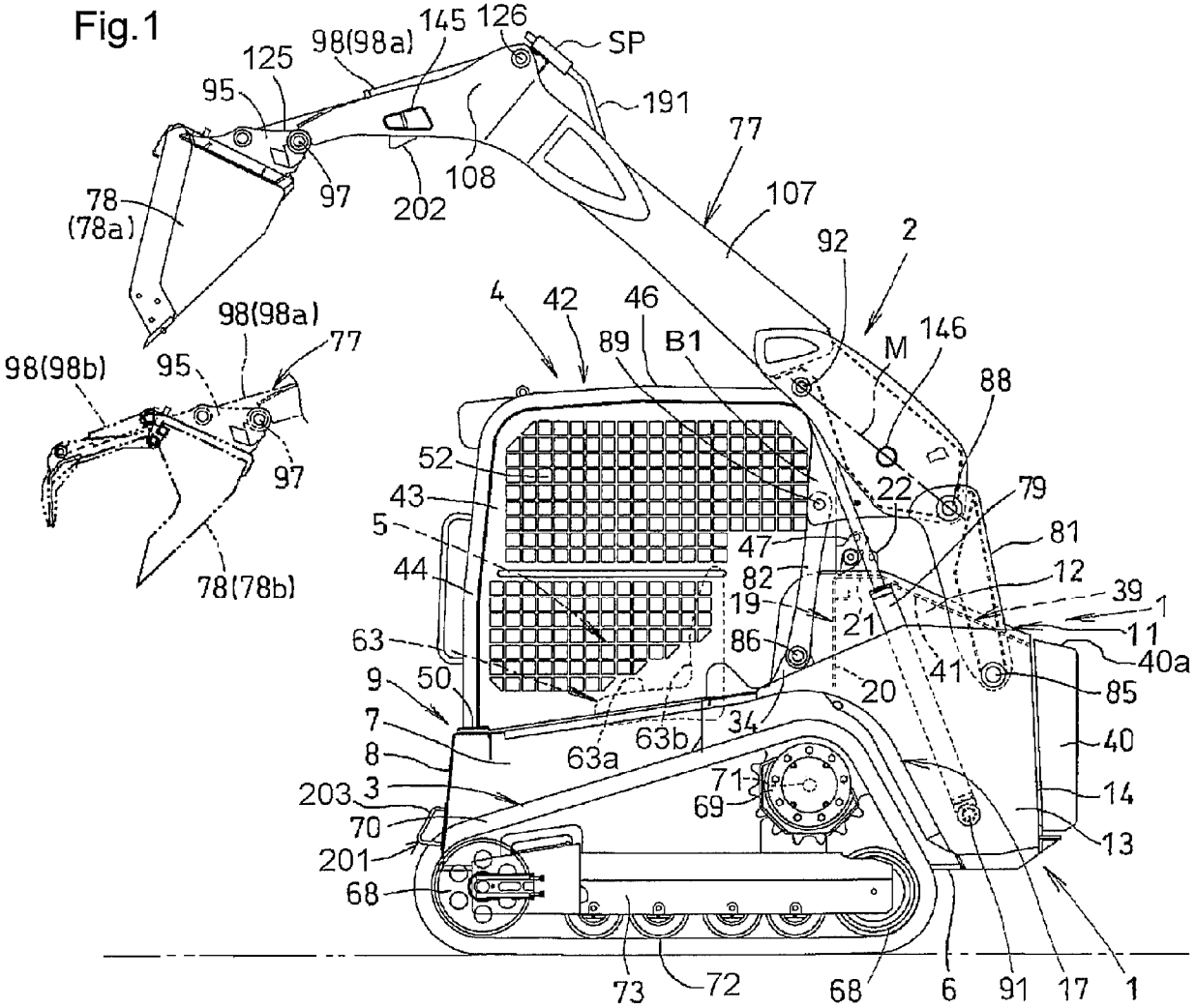
FIG. 1 is a side view of a loader work machine according to the present invention when an arm is lifted.
Figure 2:
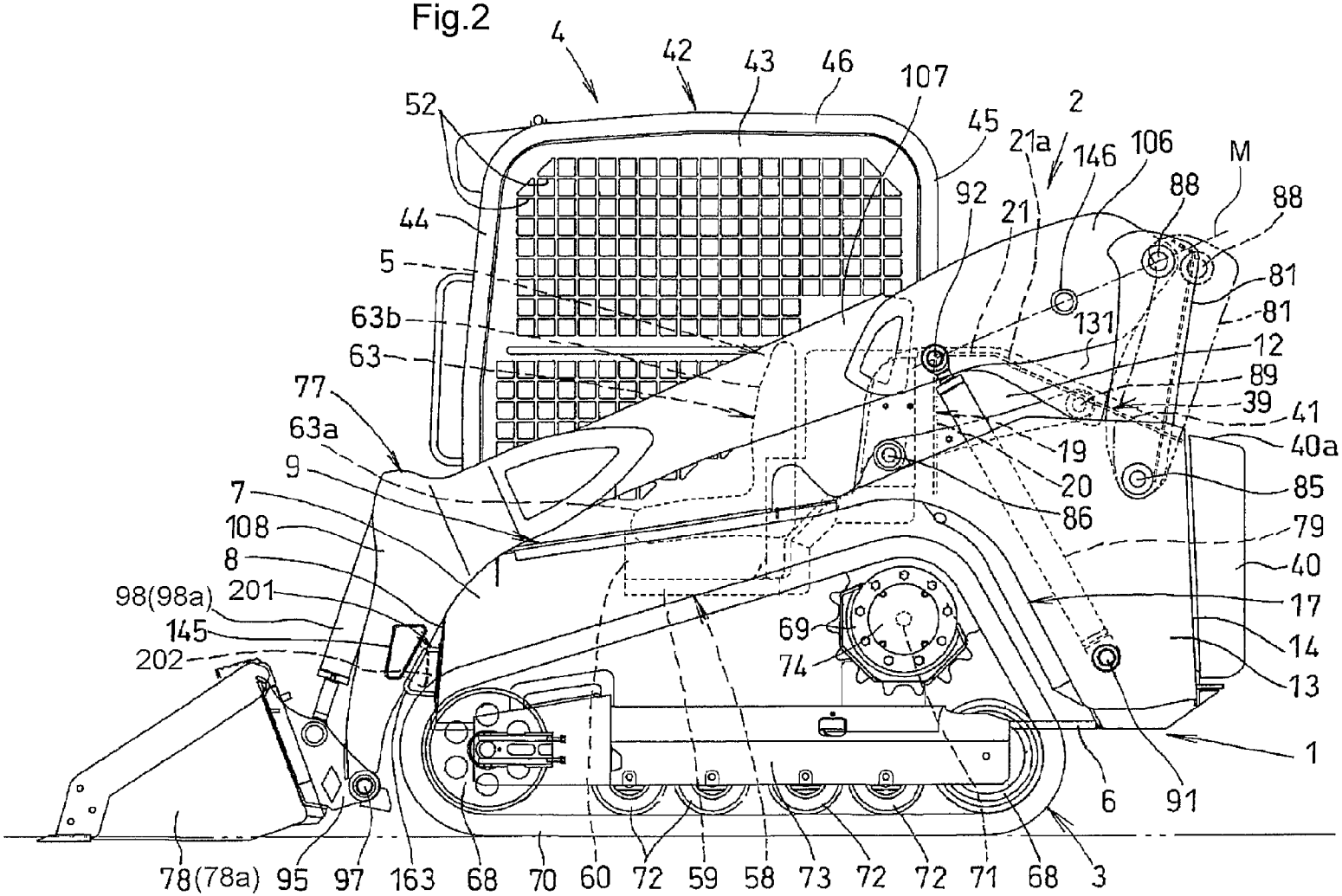
FIG. 2 is a side view of the loader work machine when the arm is lowered.
Figure 3:
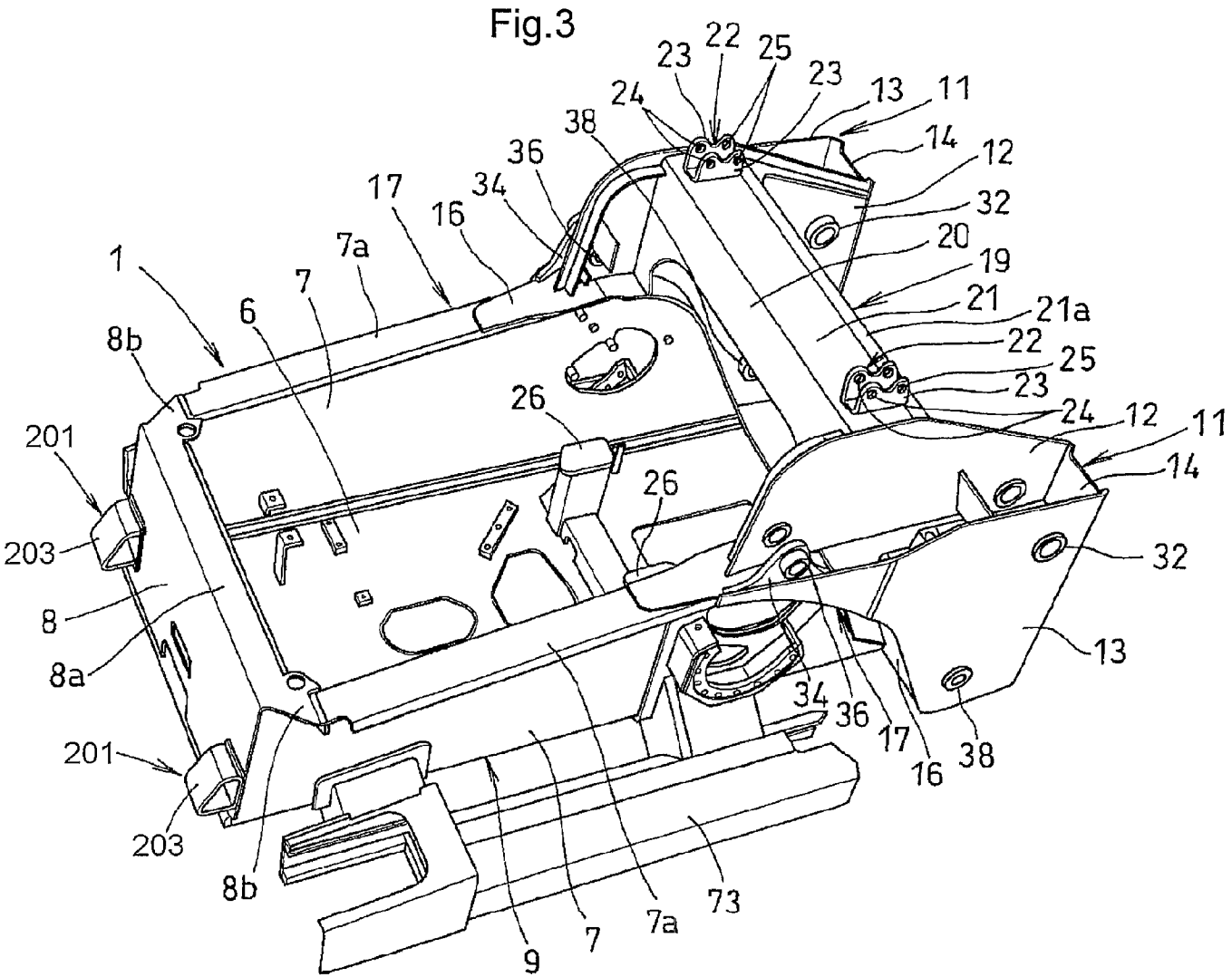
FIG. 3 is a perspective view of a body frame seen from above and a front side.
Figure 4:
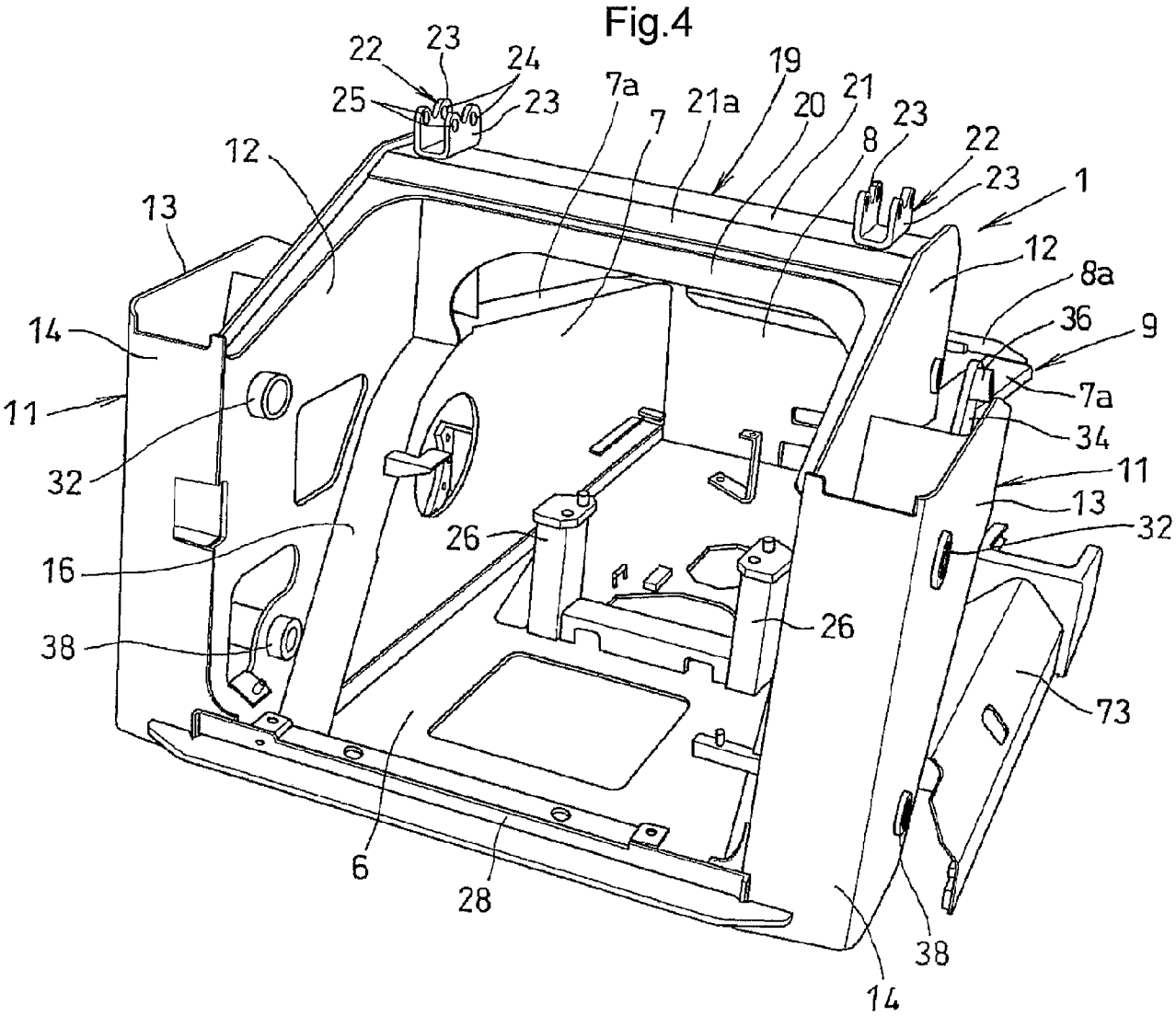
FIG. 4 is a perspective view of the body frame seen from a rear side.
Figure 5:
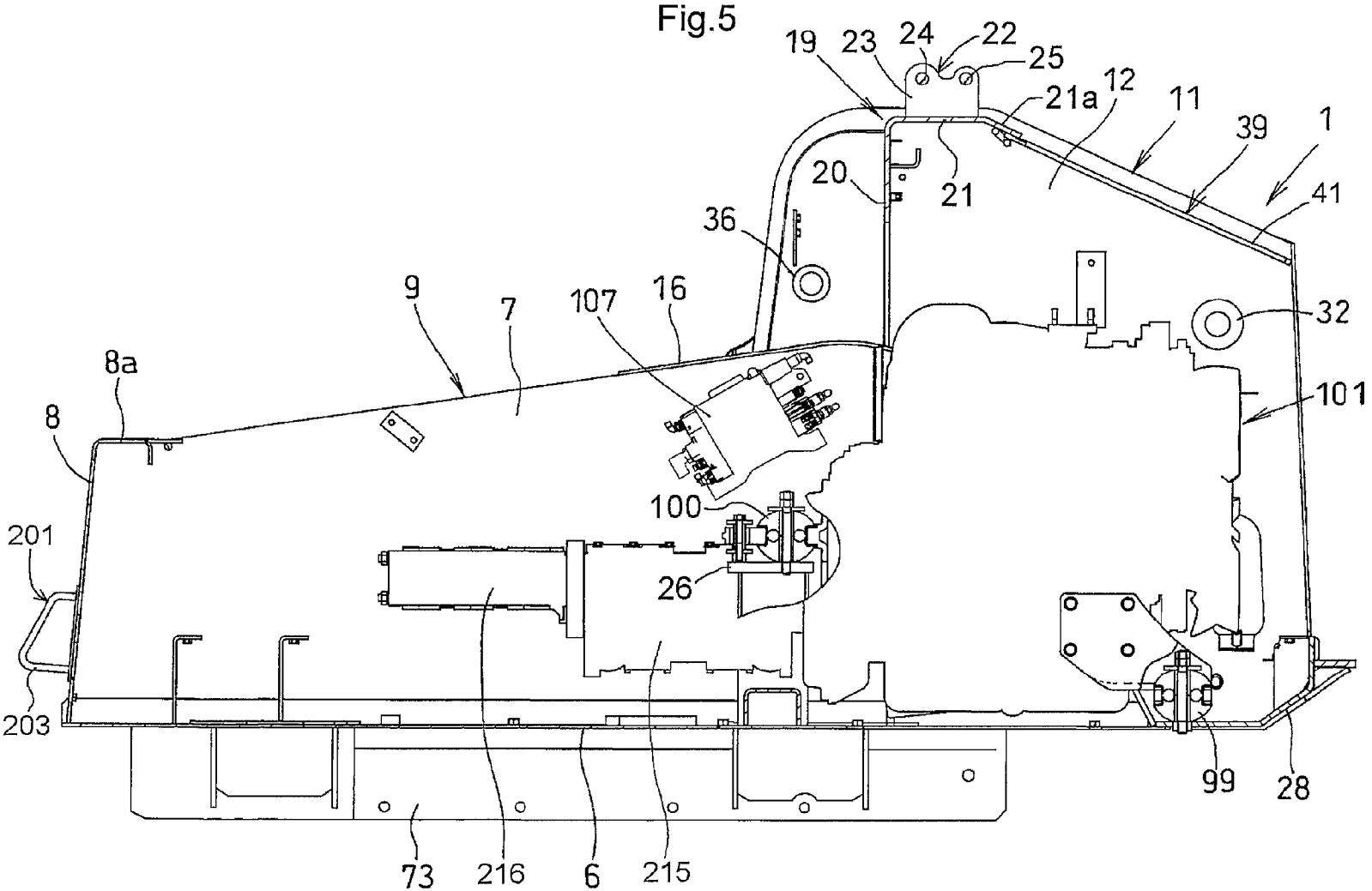
FIG. 5 is a side view in vertical section of the body frame.
Figure 6:
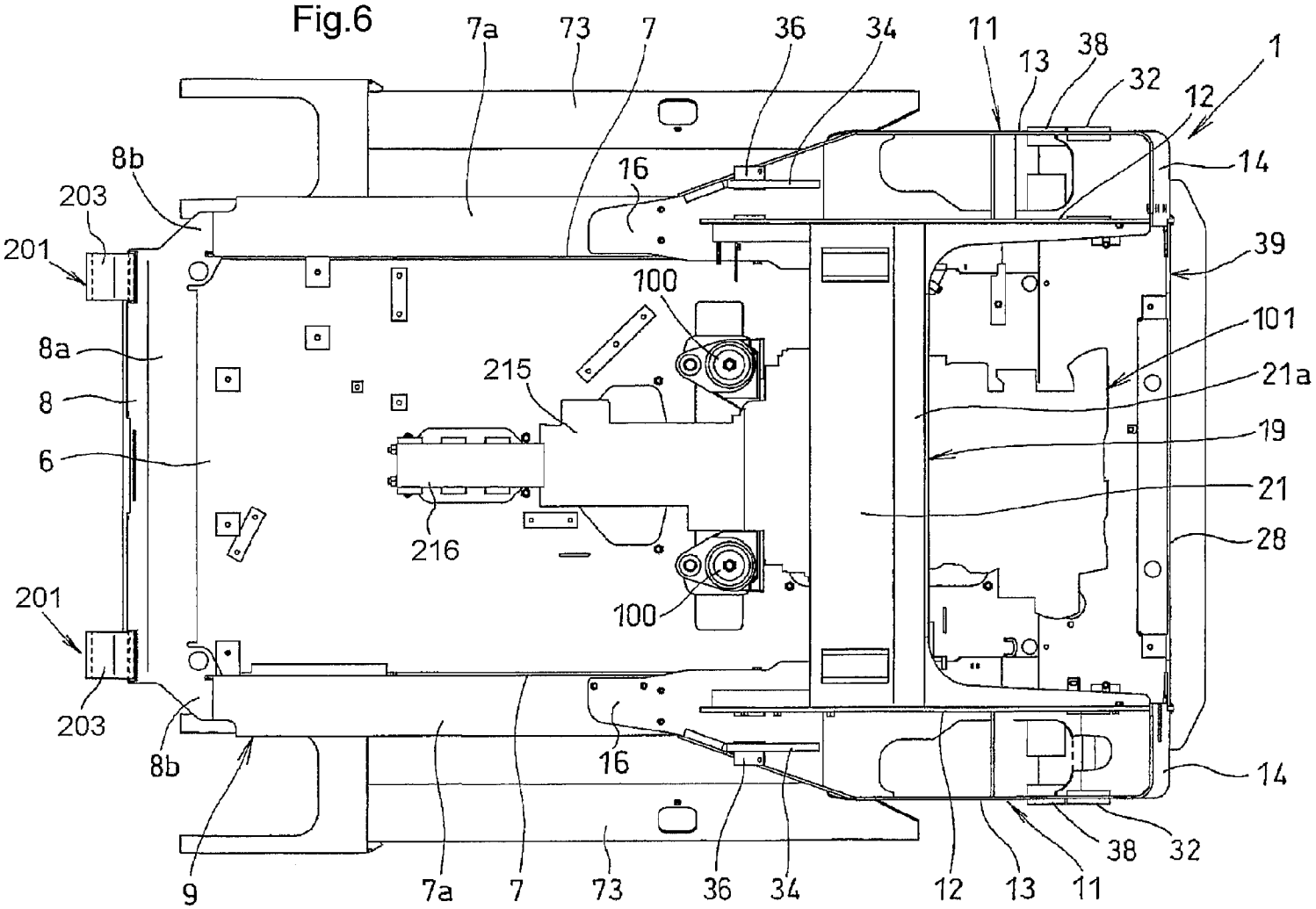
FIG. 6 is a plan view of the body frame.
Figure 7:
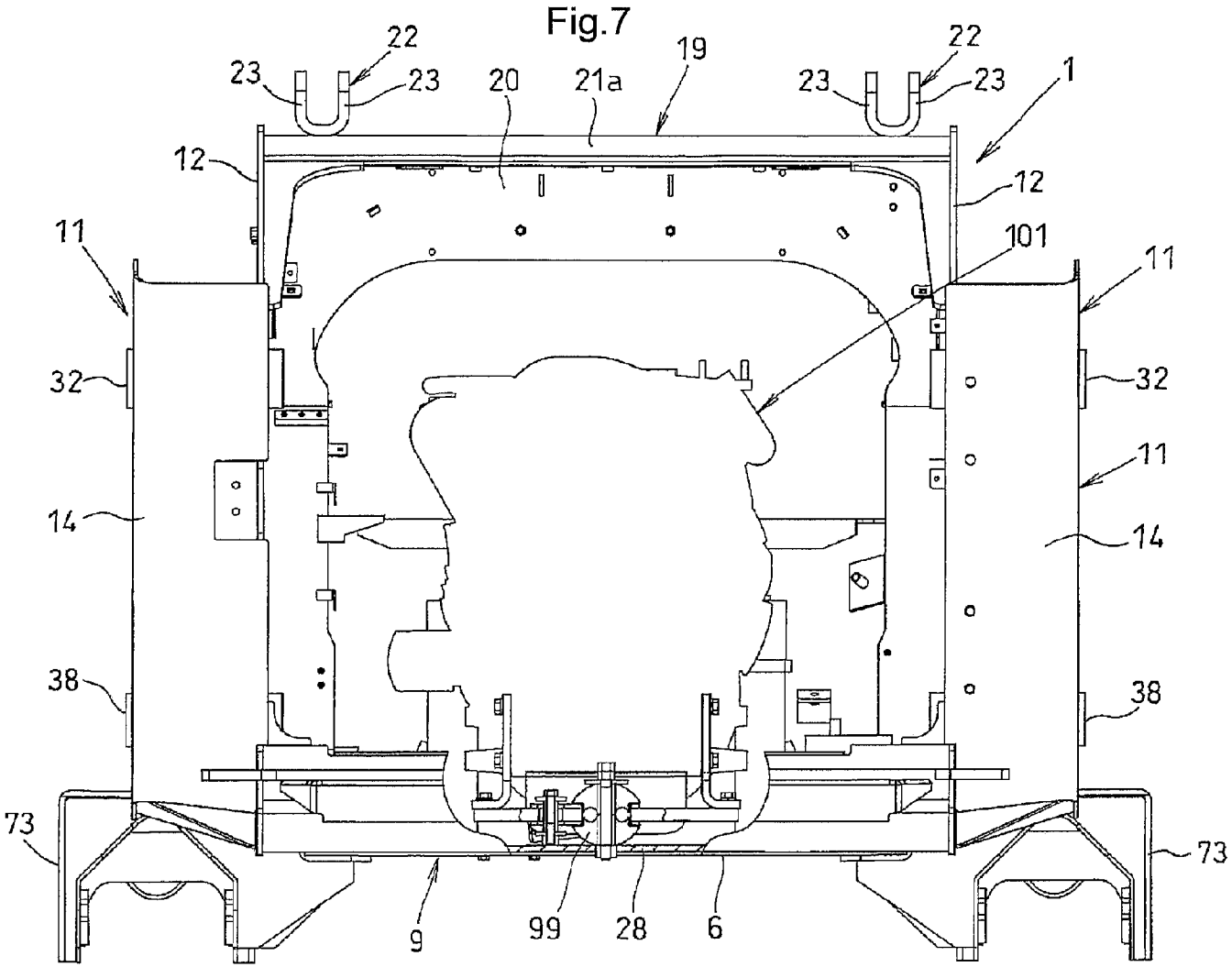
FIG. 7 is a rear view of the body frame.

Referring to FIGS. 1 and 2, a truck loader, an example of a loader work machine according to the present invention, includes: a body frame 1; a loader working device (excavator working device) 2 attached to the body frame 1; and a pair of right/left traveling devices 3 configured to support the body frame 1. A driving part 5 is provided above the body frame 1, with a driver's seat 63 which will be described later, control levers etc. mounted thereon. On a front portion of the body frame 1, a cabin (driver protector) 4 surrounding the driving part 5 is mounted. The loader working device 2 includes a pair of right/left arms 77 and a bucket (working implement) 78 attached between tip end portions of the arms 77.

A pair of the right/left arms 77 are disposed on both lateral sides of the body frame 1, the driving part 5 or the cabin 4. Each of the right/left arms 77 has a base portion thereof supported on a rear upper portion of the body frame 1, swingably in a vertical direction through a first, rear lift link 81 and a second, front lift link 82; and a tip end side thereof lifted and lowered frontward of the body frame 1. Between the base portions of the pair of the right/left arms 77 and a rear lower portion of the body frame 1, a pair of right/left arm cylinders 79, each comprised of a double-acting hydraulic cylinder, are provided.

(Configuration of Frame and Hood)

Referring to FIGS. 3-7, the body frame 1 formed of iron plate or the like includes a frame main body 9 and a pair of right/left support frames 11. A pair of the right/left support frames 11 are connected by welding to a rear end side of the frame main body 9. The frame main body 9 is formed in a box shape with an upper side thereof opened, and includes a bottom wall 6, a pair of right/left side walls 7 and a front wall 8. An upper rim of a rear end portion of each of the right/left side walls 7 has an arc shape which is gradually inclined downward and rearward. On an upper end of each of the right/left side walls 7, a bent rim portion 7*a* protruding laterally outward is provided. On an upper end of the front wall 8, a bent rim portion 8*a* protruding rearward is provided. On each of lateral sides of the bent rim portion 8*a*, a connecting piece 8*b* extends rearward. The connecting piece 8*b* is welded to a front end of the corresponding bent rim portion 7*a*.

Each of the support frames 11 includes an inner wall 12, an outer wall 13 and a frame connecting wall 14 interconnecting a rear end of the inner wall 12 and a rear end of the outer wall 13; and has a squared C-shape as a whole.

A mounting plate 16 curved in an arc shape is disposed on the rear end portion of the side wall 7 in such a manner that the mounting plate 16 and the side wall 7 are arranged in a T-shape or L-shape, and an inner side portion of the mounting plate 16 is welded to the side wall 7. A rear end portion of the bent rim portion 7*a* is overlapped with and welded to a front end portion the mounting plate 16. An outer side portion of the mounting plate 16 protrudes outward in the transversal direction from the upper end of the side wall 7. The bent rim portion 7*a* and the mounting plate 16 constitute a fender 17 configured to cover an upper side and a rear side of the traveling device 3.

The inner wall 12 and the outer wall 13 is disposed laterally outward of the side wall 7 of the frame main body 9, and a front lower end of each of the inner wall 12 and the outer wall 13 is welded to an upper face of the outer side portion of the mounting plate 16. With this configuration, each of the right/left support frames 11 is connected and fixed to the side wall 7 of the body frame 1 through the mounting plate 16. An upper portion of each of the inner wall 12, the outer wall 13 and the frame connecting wall 14 of the support frame 11 protrudes above the side wall 7. In this manner, while ensuring adequate stiffness of the body frame 1, spacing distances between a pair of the right/left support frames 11, between a pair of the right/left first lift links 81 and between a pair of the right/left arms 77 can be made larger than a transverse width of the frame main body 9. Accordingly, a transverse width of the cabin 4 (which will be described later) is adequately secured, enhancing comfort of the cabin 4.

The upper portions of the inner walls 12 of the right/left support frames 11*a* are connected to each other through a transversal connecting member 19. The transversal connecting member 19 includes: a gate-shaped front wall plate 20; and an upper wall plate 21 protruding rearward from an upper end of the front wall plate 20. A rear portion 21*a* of the upper wall plate 21 is inclined downward and rearward. On both lateral end portions of the upper wall plate 21, a pair of right/left support brackets 22 each having a U-shape protruding upward are provided. Each of the right/left support brackets 22 has a pair of right/left support plate portions 23, and each of the support plate portions 23 has a mounting hole 24 on a front side and a locking hole 25 on a rear side, both penetrating in a transverse direction.

In an intermediate portion of a rear portion of the bottom wall 6 of the frame main body 9, a pair of right/left support bases 26 protruding upward are provided. On a rear end portion of the frame main body 9, an elongated bottom member 28 extends along a rear end of the bottom wall 6. The elongated bottom member 28 is connected and welded to the pair of the right/left support frames 11, and is welded to a rear end portion of the bottom wall 6 of the frame main body 9. In other words, lower ends of the right/left support frames 11 are connected to each other through the elongated bottom member 28. The elongated bottom member 28 is connected and welded to the bottom wall 6 of the body frame 1, both end portions of the elongated bottom member 28 are welded to the respective inner walls 12 or the frame connecting walls 14, and a pair of the right/left support frames 11 are connected to the bottom wall 6 through the elongated bottom member 28. The elongated bottom member 28 includes: an elongated bottom wall portion 28*a* on which a rear portion of an engine 101 (which will be described later) is mountable; and a standing rear wall portion 28*b* vertically arranged on a rear end of the elongated bottom wall portion 28*a*.

In an upper rear end portion of the support frame 11, a first mounting boss 32 having a mounting hole is provided between the inner wall 12 and the outer wall 13. On an upper front end portion of the outer wall 13, a stay member 34 protruding rearward and upward is provided. A front end portion and a lower end of the stay member 34 are fixed to the outer wall 13 and the mounting plate 16 by welding or the like. Between the stay member 34 and the inner wall 12, a second mounting boss 36 having a mounting hole is provided. In a lower end portion of the support frame 11, a third mounting boss 38 having a mounting hole is provided between the inner wall 12 and the outer wall 13.

As shown in FIGS. 5-8, on a rear side above the bottom wall 6 of the body frame 1, the engine 101 is provided. Specifically, the engine 101 is mounted on the bottom wall 6, the right/left side walls 7 covers lateral sides of the engine 101, and the transversal connecting member 19 connects upper portions of the support frames 11 above an intermediate portion in a front-rear direction of the engine 101. A central portion in the transverse direction on a rear side of the engine 101 is set on and fixed to the elongated bottom member 28 through an anti-vibration member 99, and right/left portions on a front side of the engine 101 are set on and fixed to the right/left support bases 26, respectively, through corresponding anti-vibration member 100.

As shown in FIGS. 5-8, on the rear side above the bottom wall 6 of the body frame 1, the engine 101 is provided. Frontward of the engine 101, a running hydraulic controller 215 is provided, and frontward of the running hydraulic controller 215, a triple gear pump 216 is provided. On an intermediate portion in the front-rear direction of the side wall 7 on a right side, a work control valve (hydraulic controller) 217 is provided.

By inputting a power of the engine 101 through the running hydraulic controller 215, the gear pump 216 performs feeding and discharging of operating oil in an operating oil tank to and from the arm cylinders 79 and a hydraulic actuator 98 for working implement (a dump/tilt actuator 98*a* and a movable part actuator 98*b*) (which will be described later), through the work control valve 217. The work control valve 217 drives and controls the arm cylinders 79 and the hydraulic actuator 98 for working implement (the dump/tilt actuator 98*a* and the movable part actuator 98*b*) (which will be described later), to thereby actuate the arms 77 and the working implement 78.

In FIGS. 1-7, the transversal connecting member 19 is disposed rearward of the cabin 4 which will be described later. An engine room for housing the engine 101 is located on a rear portion side of the frame main body 9 and below the transversal connecting member 19. A hood 39 for covering the engine room is disposed on a rear end portion of the body frame 1, and includes an upper hood cover 41 and a rear hood cover 40.

The upper wall plate 21 is disposed below a central portion in the vertical direction of the cabin 4, and the rear portion 21*a* of the upper wall plate 21 is inclined downward and rearward. Rearward of the upper wall plate 21, the upper hood cover 41 is provided so as to close rear upper portion side between a pair of the right/left support frames 11. A front end portion of the upper hood cover 41 is connected to the rear portion 21*a* of the upper wall plate 21 of the transversal connecting member 19. The upper hood cover 41 is inclined downward and rearward, so as to correspond to the rear portion 21*a* of the upper wall plate 21.

Therefore, as compared with a height of the cabin 4, a height of the entire hood 39 disposed rearward of the cabin 4 can be suppressed low, and thus the hood 39 is not likely to hinder a rear view. During a working operation or the like, the operator in the cabin 4 can visually check an area rearward and downward of the hood 39, facilitating a smooth working operation of the loader work machine.

As shown in FIG. 1, a height hl from a lower end of the body frame 1 to a rear end of the upper hood cover 41 is set to one half or less of a height H1 from the lower end of the body frame 1 to an upper end of the cabin 4. When the height hl is suppressed low as compared with the height H1 as such, the operator in the cabin 4 can visually check an area rearward and downward of a rear end of the upper hood cover 41, further facilitating a smooth working operation.

The upper wall plate 21 is disposed above a sitting portion 63*a* of the driver's seat 63 which will be described later, and at the same time, below an upper end of a backrest portion 63*b* of the driver's seat 63. The operator in the cabin 4 who is seating on the driver's seat 63 can visually check an area rearward and downward of the upper wall plate 21 of the transversal connecting member 19, from above the backrest portion 63*b*, and thus a smooth working operation is facilitated.

Figure 18:
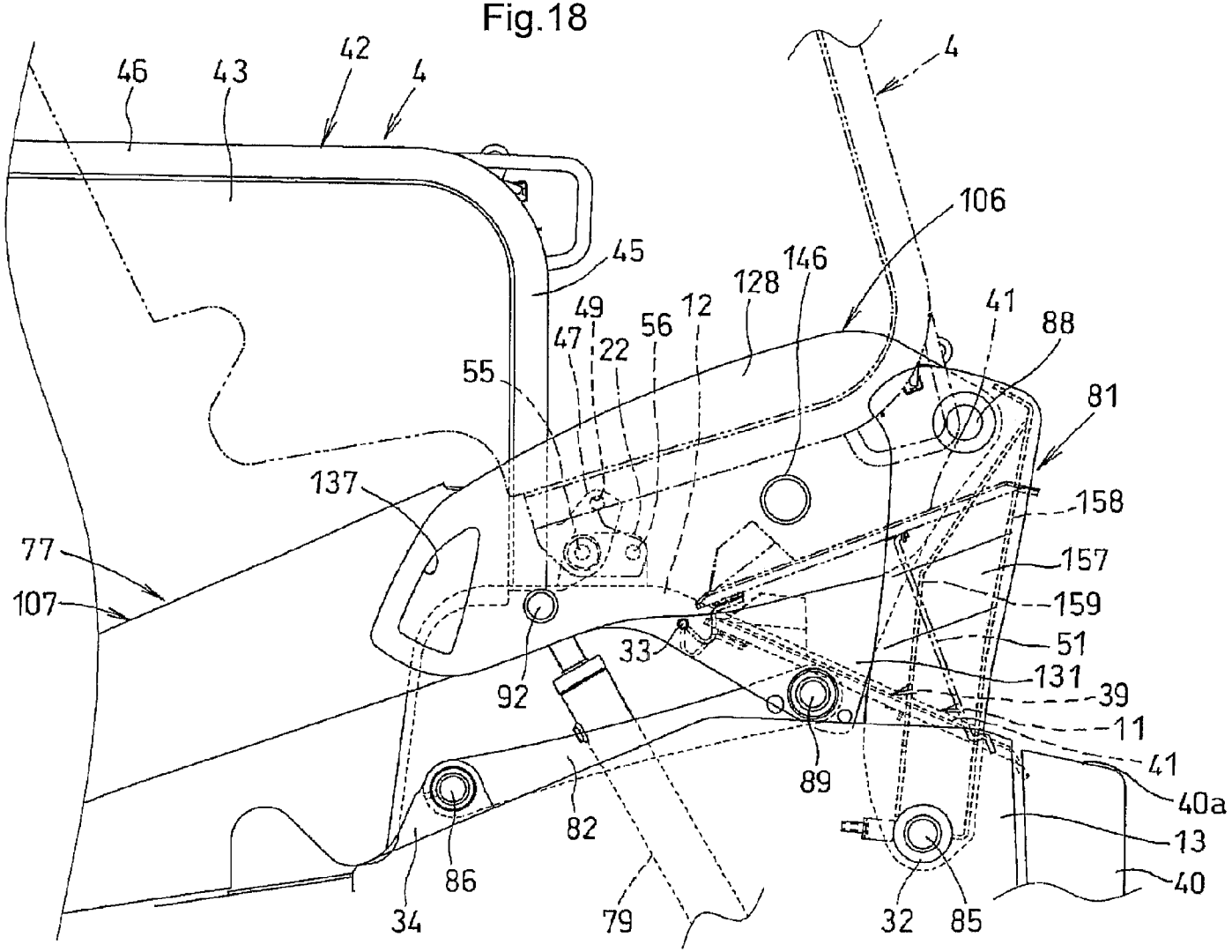
FIG. 18 is a side view from a hood to a rear portion of the aim.

As shown in FIG. 18, the upper hood cover 41 for closing an upper portion of the hood 39 is supported swingably in the vertical direction about a transverse shaft 33 with a front end side of the upper hood cover 41 as fulcrum. The upper hood cover 41 is configured to be freely opened and closed between a close position in which the upper hood cover 41 closes an upper portion side of the engine room as indicated with a broken line in FIG. 18, and an open position in which the upper hood cover 41 is inclined upward and rearward to open the upper portion side of the engine room, as indicated with a chain line in FIG. 18. In the hood 39, a retaining member 51 is provided which is configured to retain the upper hood cover 41 in the open position.

As shown in FIGS. 1, 2 and 18, the rear hood cover 40 is disposed on a rear end of the support frame 11 and is configured to be freely opened and closed so as to close an opening between rear end of the upper hood cover 41 and the standing rear wall portion 28*b* (rear end opening between a pair of the right/left support frames 11). An upper wall portion 40*a* of the rear hood cover 40 is inclined downward and rearward, so as to correspond to the upper hood cover 41. Therefore, the upper wall portion 40*a* of the rear hood cover 40 does not hinder a rear view, to thereby enhance the rear view.

(Configuration of Cabin)

As shown in FIGS. 1-7 and 18, the cabin 4 serving as the driver protector includes: a pair of right/left side frame members 42; a roof member configured to bridge upper portions of the side frame members 42; and a pair of right/left side wall bodies 43 provided on a pair of the right/left side frame members 42, respectively. A rear side of the cabin 4 is closed with a rear glass or the like, and a central portion in the front-rear direction on a lower side is closed with a bottom wall body 58 (which will be described later), and thus the cabin 4 is formed in a box shape with a front side opened. The right/left side frame members 42 are formed of pope member or the like, and include: a pair of right/left front support pole portions 44; a pair of right/left rear support pole portion 45; and a pair of right/left upper horizontal beam portions 46 each configured to connect an upper end of the front support pole portions 44 and the corresponding upper end of the rear support pole portion 45. A setting plate 50 is welded to a lower end portion of the right/left front support pole portions 44.

On lower end portions of the right/left rear support pole portions 45, a pair of right/left mounting brackets 47 protruding rearward are provided, respectively. The mounting bracket 47 corresponds to a support bracket 22, and a mounting hole and a locking hole 49 are provided so as to corresponds to the mounting hole 24 and the locking hole 25 of the support bracket 22, respectively.

The side wall body 43 is formed of metal plate or the like, and is fixed to each of the side frame members 42 by welding or the like. Each side wall body 43 is provided with numerous openings 52 for giving a view of the outside laterally from inside the cabin 4, and thus through the openings 52, the arm 77 or the loader working device 2 disposed laterally outward can be visually checked.

In order to mount the cabin 4 at a position frontward of the transversal connecting member 19, a cabin mount portion is provided which allows the cabin 4 to be mounted frontward of the transversal connecting member 19. The cabin mount portion includes the bent rim portion 8*a* of the front wall 8, the bent rim portion 7*a* of the side wall 7 and so on. The transversal connecting member 19 is positioned below the central portion in the vertical direction of the cabin 4, and an upper portion of the transversal connecting member 19 is provided with a support shaft 55 as a fulcrum for swingably lifting the cabin 4 rearward and upward.

The support shaft 55 extending in the transverse direction is inserted into and supported by the mounting holes 24 of the support brackets 22 and the mounting holes of the mounting brackets 47. The cabin 4 is supported swingably about the support shaft 55, on the support bracket 22 of the body frame 1 through the mounting bracket 47. With this configuration, the cabin 4 is switchable between a mount state in which a bottom side of the cabin 4 is set on the body frame 1 so as to close an upper end opening of the body frame 1 and a tilted state in which the bottom side of the cabin 4 is spaced apart upward from the body frame 1 so as to open the upper end opening of the body frame 1. As indicated with a solid line in FIG. 18, when the cabin 4 is swung frontward about the support shaft 55, the setting 50 comes into contact with and is held on an upper rim portion 8*a* of the front wall 8 through a buffer material or the like, to thereby retain the cabin 4 in the mount state. On the other hand, as indicated with a chain line in FIG. 18, when the cabin 4 is swung and tilted rearward about the support shaft 55, the locking holes 49 of a pair of the mounting brackets 47 and the respective locking holes 25 of a pair of the support brackets 22 are aligned. By inserting a locking pin 56 into the locking holes 25 and the locking hole 49, the tilted state can be retained in which the cabin 4 has been swung rearward.

In this manner, the cabin 4 is supported swingably on the body frame 1. When the cabin 4 is in the mount state, a running operation of the truck loader or a working operation of the loader working device 2 can be performed, and when the cabin 4 is in the tilted state, maintenance or the like of an inside of the body frame 1 can be performed.

The support shaft 55 is disposed on the rear side of the cabin 4 and at the central portion in the vertical direction of the cabin 4. The hood 39 is provided below the support shaft 55. An upper face of the hood 39 (an upper face of the upper wall plate 21 and an upper face of the upper hood cover 41) extends horizontally and rearward, or is inclined downward and rearward, so as not to protrude above the support shaft 55. In this manner, the upper face of the hood 39 is positioned below the support shaft 55 over a full length thereof in the front-rear direction, and extends horizontally or is inclined downward. Thus, the operator in the cabin 4 can easily see a wide range rearward and downward of the hood 39, to further facilitate a smooth working operation.

As shown in FIG. 2, the bottom wall body 58 is connected to each of a central portion in the front-rear direction of a lower end portion of the right/left side wall bodies 43, by welding or the like. The bottom wall body 58 is formed of a metal plate or the like, and includes a bottom wall portion 59 and a pair of right/left side wall portions 60, and has a squared C-shape as a whole. The driver's seat 63 is provided on an upper face of the bottom wall portion 59 through a cushion material or the like.

(Configuration of Traveling Device)

In FIGS. 1 and 2, each of the right/left traveling devices 3 includes: a pair of front and rear driven wheels 68; a drive wheel 69 disposed above and between a pair of the driven wheels 68; and a track frame 73. The track frames 73 are welded to the respective right/left side walls 7 of the frame main body 9 in a unified manner. The traveling device 3 is a crawler track traveling device in which a crawler track 70 is wound around the driven wheels 68 and the drive wheel 69. The traveling device 3 is configured to be driven by a rotation of the drive wheel 69, which is rotated about a drive shaft 71 by a rotation of the drive shaft 71.

In each of front and rear ends of the track frame 73, the driven wheel 68 is freely rotatably supported about a transverse shaft, and one of the pair of the driven wheels 68 is biased in a direction for adjusting a tension using a tension adjusting mechanism (not shown). A plurality of track rollers 72 are disposed between the pair of the driven wheels 68, and each of the track rollers 72 is freely rotatably supported about a transverse shaft on the track frame 73. The drive shaft 71 of the traveling device 3 is disposed below a rear end portion of the cabin 4.

Each of the right/left traveling devices 3 includes a hydraulic type running motor 74, which is configured to rotatably drive the drive shaft 71. Through a rotation of a drum of the running motor 74, the rotation of the drive shaft 71 rotates of the drive wheel 69 about the drive shaft 71. With this configuration, each of the traveling devices 3 is driven by the running motor 74.

(Configuration of Arms)

Figure 9:
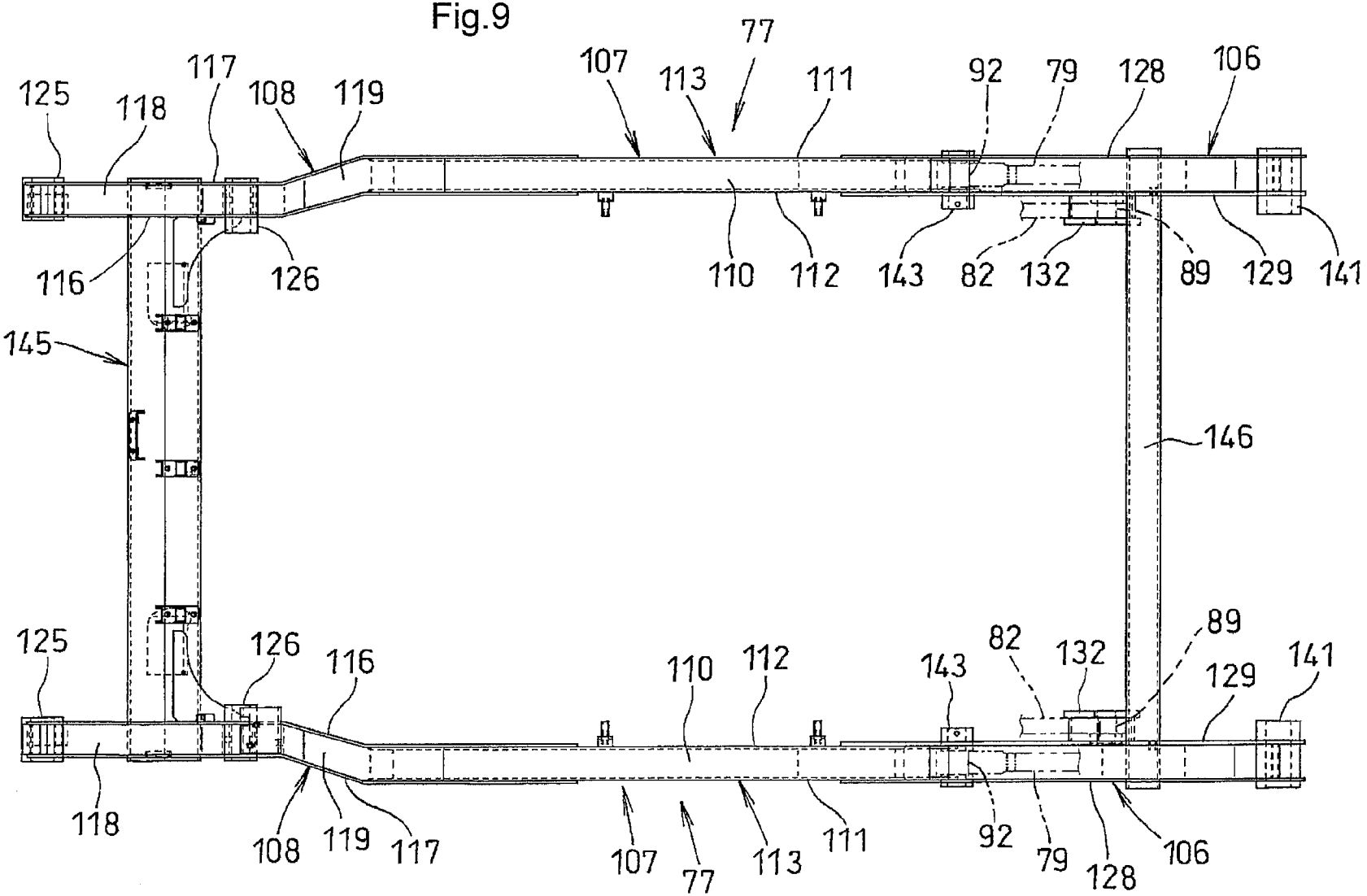
FIG. 9 is a plan view of the arm.
Figure 10:
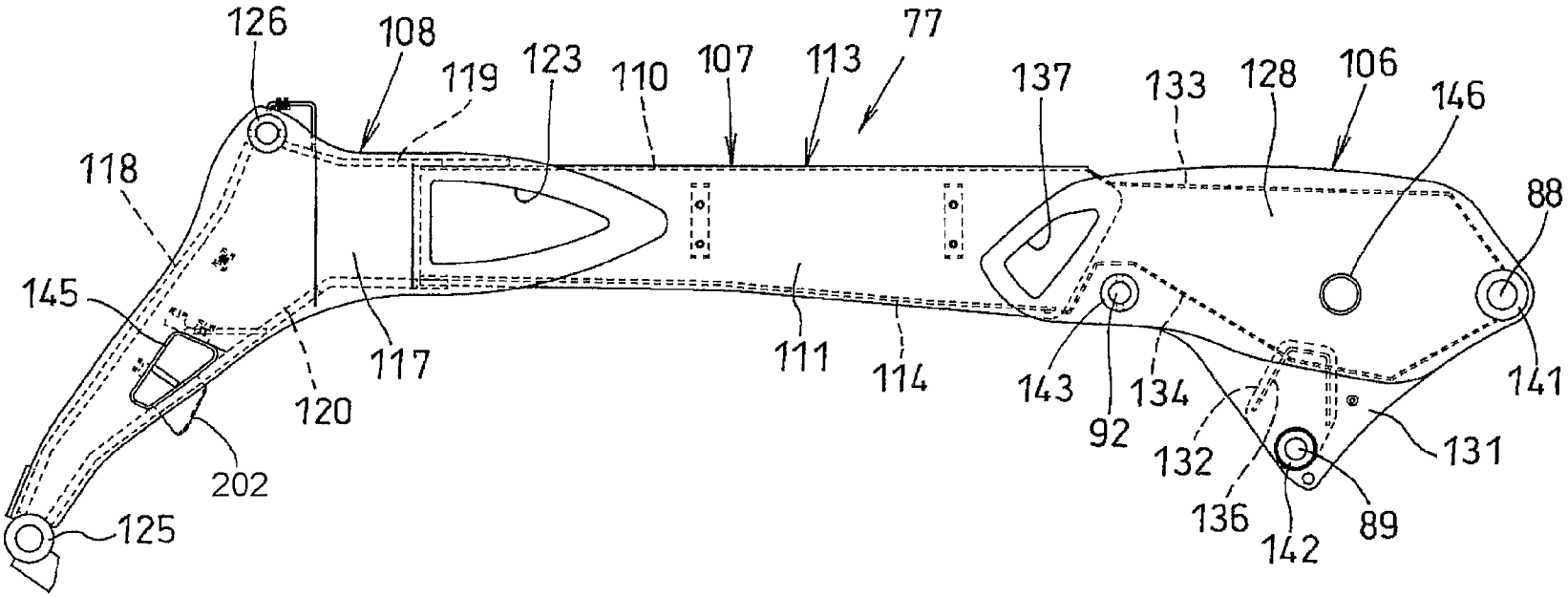
FIG. 10 is a side view of the arm.

In FIGS. 9 and 10, each of the right/left arms 77 includes a base member 106, an intermediate member 107 and a front end member 108 arranged in a longitudinal direction thereof. The intermediate member 107 includes: an intermediate member main body 113 with an upper wall 110, an outer wall 111 and an inner wall 112 arranged in a squared U-shape; and a bottom wall plate 114 connecting a lower end portion of the outer wall 111 and a lower end portion of the inner wall 112 of the intermediate member main body 113. The intermediate member main body 113 and the bottom wall plate 114 are configured as separate components. The bottom wall plate 114 is fixed by welding to the lower end portion of the outer wall 111 and the lower end portion of the inner wall 112.

The front end member 108 includes an inner wall 116 and an outer wall 117. The front end member 108 further includes a front connection wall 118, an upper connection wall 119, and a lower connection wall 120, each connecting the inner wall 116 and the outer wall 117. Each of the front connection wall 118, the upper connection wall 119 and the lower connection wall 120 is fixed by welding to the inner wall 116 and the outer wall 117.

A rear end portion of the front end member 108 is fitted on and welded to a front end portion of the intermediate member 107. A rear end portion of the inner wall 116 and a rear end portion of the outer wall 117 are disposed so as to sandwich the front end portion of the intermediate member 107 from lateral sides. Opening rim portions of respective welding holes 123 of the inner wall 116 and the outer wall 117 are welded to an inner wall and an outer wall of the intermediate member 107, respectively. A rear end portion of the upper connection wall 119 and a rear end portion of the lower connection wall 120 are disposed so as to sandwich the front end portion of the intermediate member 107 from above and below. A rear rim etc. of the upper connection wall 119 and a rear rim etc. of the lower connection wall 120 are welded to the upper wall 110 and the bottom wall plate 114 of the intermediate member 107, respectively.

In a tip end the front end member 108, a front end connection boss 125 in a shape of cylinder is provided. In an intermediate portion on an upper side of the front end member 108, an upper connection boss 126 in a shape of cylinder is provided.

The base member 106 (base portion of the arm 77) includes an outer wall 128 and the inner wall 129. An elongating mounting wall 131 in a shape of a triangle is formed by elongating the inner wall 129, so as to protrude downward of a lower rim of the outer wall 128. On an inner side in the transverse direction of the elongating mounting wall 131, an inner bracket 132 is provided in such a manner that it faces the elongating mounting wall 131.

The base member 106 includes: an upper connection wall 133 extending along upper rim portions of the inner wall 129 and outer wall 128; and a lower connection wall 134 extending along lower rim portions of the inner wall 129 and the outer wall 128. The inner wall 129 and the outer wall 128 are connected through the upper connection wall 133 and the lower connection wall 134. A bracket connection wall 136 extends along an upper rim portion of the inner bracket 132. The inner bracket 132 is connected through the bracket connection wall 136 to an internal side face of the elongating mounting wall 131 or an internal side face of the inner wall 129. When seen from a lateral side, an intermediate portion of the bracket connection wall 136 protrudes above the lower connection wall 134 so that the bracket connection wall 136 crosses the lower connection wall 134.

In this manner, by crossing the bracket connection wall 136 and the lower connection wall 134, a protruding base portion side of the elongating mounting wall 131 of the arm 77 is reinforced by the bracket connection wall 136 and the lower connection wall 134. Accordingly, the support of the second lift link 82 by the elongating mounting wall 131 and inner bracket 132 becomes strong.

A front end portion of the base member 106 is fitted on and welded to a rear end portion of the intermediate member 107. A front end portion of the inner wall 129 of the base member 106 and a front end portion of the outer wall 128 are disposed so as to sandwich the rear end portion of the intermediate member 107 from lateral sides. Opening rim portions of respective welding holes 137 of the inner wall 129 and the outer wall 128 are welded to the inner wall 112 and the outer wall 111 of the intermediate member 107, respectively. A front end portion of the upper connection wall 133 of the base member 106 and a front end portion of the lower connection wall 134 are disposed so as to sandwich the rear end portion of the intermediate member 107 from above and below. A front rim and the like of the upper connection wall 133 and a front rim and the like of the lower connection wall 134 are welded to the upper wall 110 and the bottom wall plate 114 of the intermediate member 107, respectively.

In a rear end portion of the base member 106 and between the inner wall 129 and the outer wall 128, a first connection boss 141 having a mounting hole is provided. Between the elongating mounting wall 131 and the inner bracket 132, a second connection boss 142 having a mounting hole is provided. Frontward of the first connection boss 141 and the elongating mounting wall 131, and between the inner wall 129 and the outer wall 128, a third connection boss 143 having a mounting hole is provided. A rear end of the upper connection wall 133 and a rear end of the lower connection wall 134 are connected to the first connection boss 141. An intermediate portion of the lower connection wall 134 is provided above the third connection boss 143 so as not to be brought into contact with the third connection boss 143.

A first arm shaft 88 is inserted into and supported by the first connection boss 141, through the mounting hole thereof. A second arm shaft 89 is inserted into and supported by the second connection boss 142, through the mounting hole thereof. An upper cylinder shaft 92 is inserted into and supported by the third connection boss 143 through the mounting hole thereof.

As shown in FIGS. 9 and 10, the tip end sides of the right/left arms 77 are connected through a front connecting member 145, and at the same time, a base side of the right/left arms 77 are connected through a rear connecting member 146. The front connecting member 145 is formed of a pipe member in a shape of prismatic pillar. The front connecting member 145 is inserted into the tip end portions of the right/left arms 77 (the inner wall 116 and the outer wall 117 of the front end member 108) in a penetrated state and is welded to the arms 77. The rear connecting member 146 is formed of a cylindrical pipe member. The rear connecting member 146 is inserted into a base end side of the right/left arms 77 (the inner wall 129 and the outer wall 128 of the base member 106) in a penetrated state and is welded to the arms 77. The right/left arms 77, the front connecting member 145 and the rear connecting member 146 together form a rectangular frame. As a result, stiffness of a pair of the right/left arms 77 can be enhanced, and for example, during a working operation, even when the right/left arms 77 suffer a large impact from the working implement 78 on the tip end side of the arm 77, torsion and backlash of the right/left arms 77 can be effectively prevented.

As shown in FIG. 9, intermediate portions on a front end side of the right/left arms 77 are bent inward in the transverse direction so that a transverse spacing distance between front end portions of the right/left arms 77 becomes smaller than transverse spacing distance between rear portions.

Figure 8:
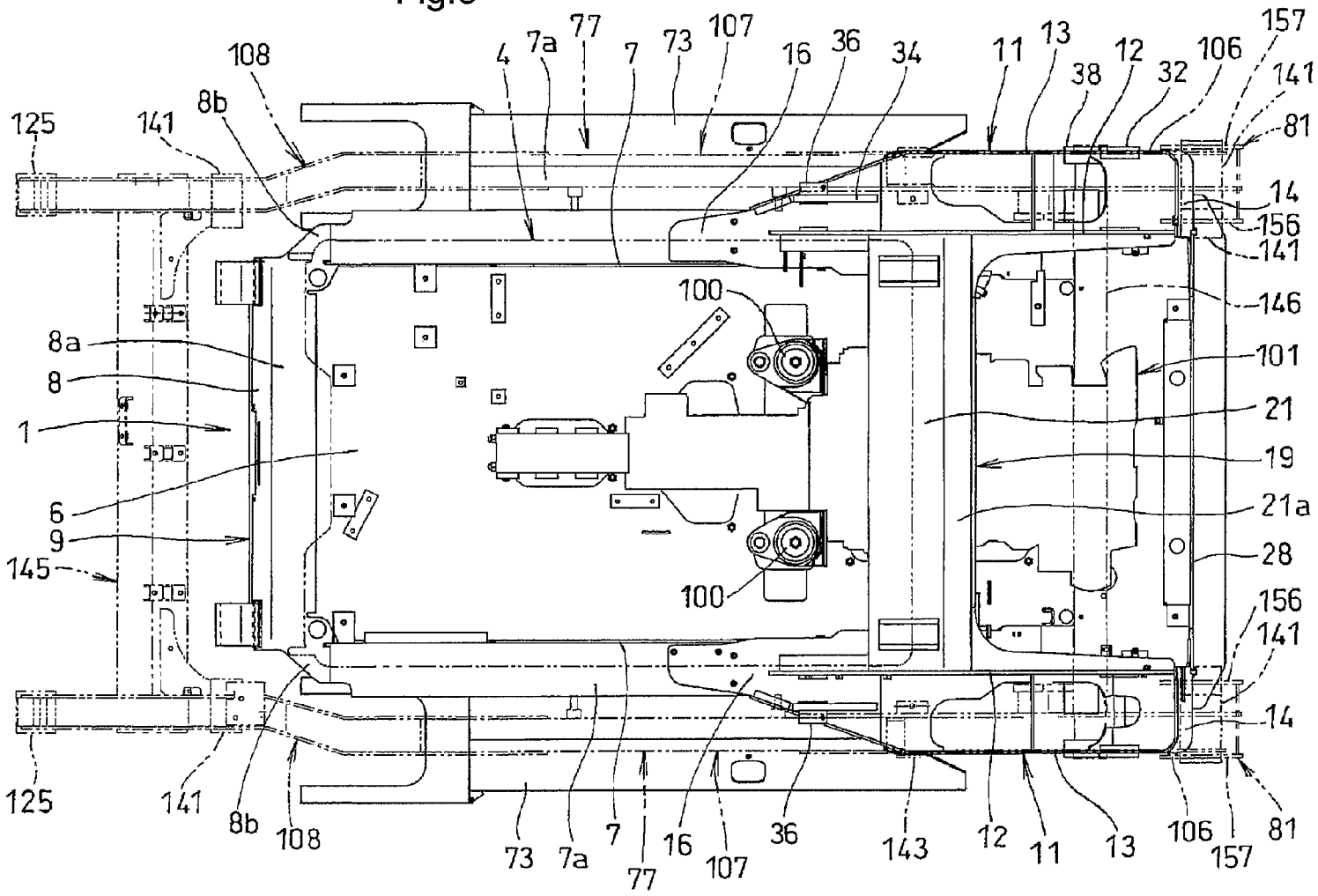
FIG. 8 is a plan view showing a positional relationship of the body frame, a cabin and the arm.

As shown in FIG. 8, the arms 77 are located on both lateral sides of the body frame 1, the driving part 5 or the cabin 4. A spacing distance of the right/left arms 77 is set larger than a spacing distance of the right/left side walls 7 of the frame main body 9. A whole length of the right/left arms 77 is disposed inside of a transverse width between outer ends of the right/left traveling devices 3, and at the same time, outside of a transverse width between inner ends of the right/left traveling devices 3. The transverse width of the cabin 4 is set larger than the spacing distance of the right/left side walls 7 of the frame main body 9, and both lateral sides of the cabin 4 protrude laterally outward of the respective right/left side walls 7 of the frame main body 9.

The base portion of the arm 77 is, as shown in FIGS. 1, 2, 9 and 10, supported on the rear upper portion of the body frame 1, swingably in the vertical direction through the first lift link 81 on the rear side and the second lift link 82 on the front side. Therefore, the tip end side of the arm 77 is allowed to be lifted and lowered frontward of the body frame 1. Between the base portion of a pair of the right/left arms 77 and the rear lower portion of the body frame 1, a pair of the right/left arm cylinders 79 each formed of a double-acting hydraulic cylinder are provided.

As shown in FIGS. 1, 2, 13 and 14, a lower base portion of the first lift link 81 is inserted between a portion of the inner wall 12 and a portion of the outer wall 13 corresponding to the first mounting boss 32, and a first link shaft 85 is inserted into the mounting hole of the first mounting boss 32 and the lower base portion of the first lift link 81. In this manner, the lower base portion of the first lift link 81 is supported swingably in the front-rear direction about the first link shaft 85 on the body frame 1 (by the first mounting boss 32).

A front base portion of the second lift link 82 is inserted between a portion of the stay member 34 and a portion of the inner wall 12 corresponding to the second mounting boss 36 of the body frame 1, and a second link shaft 86 penetrates the mounting hole of the second mounting boss 36 and the front base portion of the second lift link 82. In this manner, the front base portion of the second lift link 82 is supported swingably in the vertical direction about the second link shaft 86 on the body frame 1 (by the second mounting boss 36), frontward of the first link shaft 85.

A lower base portion of the arm cylinder 79 is inserted between a portion of the inner wall 12 and a portion of the outer wall 13 corresponding to the third mounting boss 38 of the body frame 1, and a lower cylinder shaft 91 is inserted into the mounting hole of the third mounting boss 38 and the lower base portion of the arm cylinder 79. In this manner, the lower base portion of the arm cylinder 79 is connected swingably about the lower cylinder shaft 91 to the body frame 1.

With this configuration, an upper free end side of the first lift link 81 and an upper tip end side of the arm cylinder 79 can be easily connected to the base portion of the arm 77.

The base portion of the arm 77 is pivotally supported by the first arm shaft 88 on the upper free end side of the first lift link 81, and is supported swingably in the vertical direction about the first arm shaft 88. In addition, frontward of the first arm shaft 88, the base portion of the arm 77 is pivotally supported by the second arm shaft 89 on a free end side of the second lift link 82, and is supported swingably in the vertical direction about the second arm shaft 89. Moreover, the upper tip end side of the arm cylinder 79 is connected swingably about the upper cylinder shaft 92 to the base portion of the arm 77.

Specifically, each of the upper free end side of the first lift link 81 and the upper tip end side of the arm cylinder 79 is connected swingably to the arm 77 between the inner wall 129 and the outer wall 128. The free end side of the second lift link 82 is connected swingably between the elongating mounting wall 131 and the inner bracket 132. In other words, the upper free end side of the first lift link 81 is connected swingably by the first arm shaft 88 at a position rearward of the elongating mounting wall 131, while the upper tip end side of the arm cylinder 79 is connected swingably by the upper cylinder shaft 92 frontward of the elongating mounting wall 131. The free end side of the second lift link 82 is connected swingably by the second arm shaft 89, below a connection line M connecting the first arm shaft 88 and the upper cylinder shaft 92.

In addition, as described above, since the elongating mounting wall 131 protrudes downward of the lower rim of the outer wall 128 from the inner wall 129 of the base portion of the arm 77, when the free end side of the second lift link 82 is connected between the inner wall 129 of the base portion of the arm 77 and the inner bracket 132, the outer wall 128 does not interfere. Accordingly, the second arm shaft 89 can be easily inserted from outside the arm 77 in the transverse direction, into the elongating mounting wall 131 of the base portion of the arm 77, the inner bracket 132 and the free end side of the second lift link 82. As a result, workability to connect the first lift link 81, the second lift link 82 and the arm cylinder 79 to the base portion of the arm 77 is enhanced.

Further, since the outer wall 128 of the base portion of the arm 77 does not interfere, grease application from outside the arm 77 in the transverse direction to a connecting portion between the upper free end side of the first lift link 81 and the base portion of the arm 77, and a connecting portion between the upper tip end side of the arm cylinder 79 and the base portion of the arm 77 is facilitated. In addition, grease application from outside the arm 77 in the transverse direction to a connecting portion between the free end side of the second lift link 82 and the base portion of the arm 77 is facilitated.

The second arm shaft 89 and the second link shaft 86, together with the first link shaft 85, the first arm shaft 88, the lower cylinder shaft 91, and the upper cylinder shaft 92, are configured to be visually checked from outside the body frame 1 in the transverse direction.

The rear connecting member 146 in the arms 77 is disposed frontward of the first arm shaft 88, and at the same time, disposed on the connection line M connecting the first arm shaft 88 and the upper cylinder shaft 92. Therefore, when the driver in the driving part 5 sees rearward and performs an operation or the like, by visually checking a height of the rear connecting member 146 positioned rearward, the driver is allowed to guess a height level of the working implement 78 on the tip end side of the arm 77 with some degree of accuracy, and thus a working operation is facilitated.

In addition, the rear connecting member 146 is positioned closer to the first arm shaft 88, rather than to the upper cylinder shaft 92. Therefore, when the arms 77 is lifted and lowered by the extension and contraction of the arm cylinders 79, backlash of the right/left first lift links 81 in the transverse direction can be surely prevented.

When the arm cylinder 79 is contracted and the arm 77 is lowered (in the lowermost state), the rear connecting member 146 is positioned below the first arm shaft 88. On the other hand, when the arm cylinder 79 extends and the arm 77 is lifted (in the uppermost state), the rear connecting member 146 is positioned above the first arm shaft 88. The upper cylinder shaft 92 is disposed frontward of the rear connecting member 146, and when the arm 77 is in the lowermost state, the upper cylinder shaft 92 is positioned below the rear connecting member 146. When the arm 77 is in the uppermost state, the upper cylinder shaft 92 is positioned above the rear connecting member 146. The rear connecting member 146 is disposed at an intermediate position between the first arm shaft 88 and the upper cylinder shaft 92.

The rear connecting member 146 is disposed rearward of the cabin 4. When the arm 77 is in the lowermost state, in order to prevent interference between the cabin 4 in the tilted state and the rear connecting member 146, the rear connecting member 146 and the cabin 4 are spaced apart from each other in the front-rear direction.

When the arm 77 is in the lowermost state, in order to allow the upper hood cover 41 to be retained at the open position by the retaining member 51, the rear connecting member 146 is spaced apart above the upper hood cover 41. Even in a state in which the arm 77 is lowered, the upper hood cover 41 can be retained at the open position by the retaining member 51, which is convenient for inspection or the like of an inside of the hood 39.

(First Lift Link)

Figure 11:
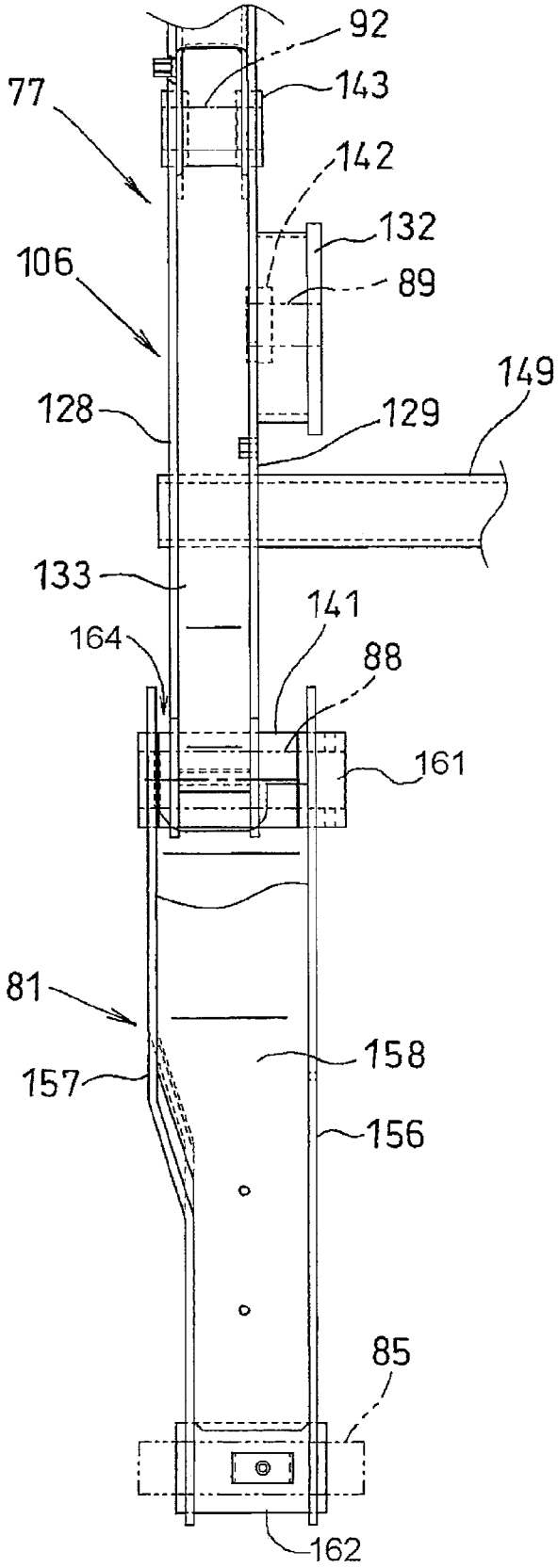
FIG. 11 is a rear view of a first lift link and the arm when the arm is lifted.

As shown in FIGS. 11 and 18, the first lift link 81 includes: an inner wall 156; an outer wall 157; and a link rear portion connection wall 158 (link connection wall) connecting rear end portions of the inner wall 156 and outer wall 157 to each other. The first lift link 81 formed of the inner wall 156, the outer wall 157 and the link rear portion connection wall 158 has a squared C-shape with a front side opened. In addition, the first lift link 81 includes a link intermediate portion connection wall 159 (link connection wall) configured to connect intermediate portions in the front-rear direction of the inner wall 156 and outer wall 157 to each other.

An upper support boss 161 is provided in an upper free end portion of the first lift link 81 between the inner wall 156 and the outer wall 157, and a lower support boss 162 is provided in a base end portion of the first lift link 81 between the inner wall 156 and outer wall 157. An arm support portion 164 with a front side opened is provided on the upper free end side of the first lift link 81 between the link inner wall 156 and the link outer wall 157.

As shown in FIG. 11, the first connection boss 141 in the base portion of the arm 77 is fitted into the arm support portion 164, and the first arm shaft 88 is inserted into the first connection boss 141 and the upper support boss 161. In other words, the base side of the arm 77 is inserted into the arm support portion 164 and supported swingably in the vertical direction by the first arm shaft 88.

As shown in FIG. 8, a pair of the right/left first lift links 81 are disposed laterally outward of a pair of the right/left side walls 7 of the frame main body 9, and the lower base portions of the right/left first lift links 81 are pivotally supported by the first link shaft 85, between the inner wall 12 and the outer wall 13 of each of the right/left support frames 11. In other words, the right/left arms 77 are disposed laterally outward of the frame main body 9, in such a manner that the base side of each of the right/left arms 77 is positioned laterally outward of the side wall 7 of the frame main body 9 and pivotally supported by the first arm shaft 88 on the upper free end side of the first lift link 81.

Accordingly, it is possible to make both lateral sides of the cabin 4 mounted on the body frame 1 protrude laterally outward of the right/left side walls 7 of the frame main body 9. Therefore, the transverse width of the cabin 4 can be set larger than the spacing distance between the right/left side walls 7 of the frame main body 9, and for example, even when the transverse width of the frame main body 9 is made small to make the loader work machine compact, the transverse width of the cabin 4 is adequately secured, enhancing comfort of the cabin 4.

However, as described above, the whole length of the right/left arms 77 is disposed inside of the transverse width between the outer ends of the right/left traveling devices 3, and at the same time, outside of the transverse width between the inner ends of the right/left traveling devices 3. Therefore, even when the transverse width of the cabin 4 is adequately secured, a transverse width of the entire loader work machine can be retained within the transverse width of the right/left traveling devices 3. As a result, while enhancing comfort of the cabin 4, the loader work machine is prevented from having a large size, and from losing workability in a small space.

Figure 13:
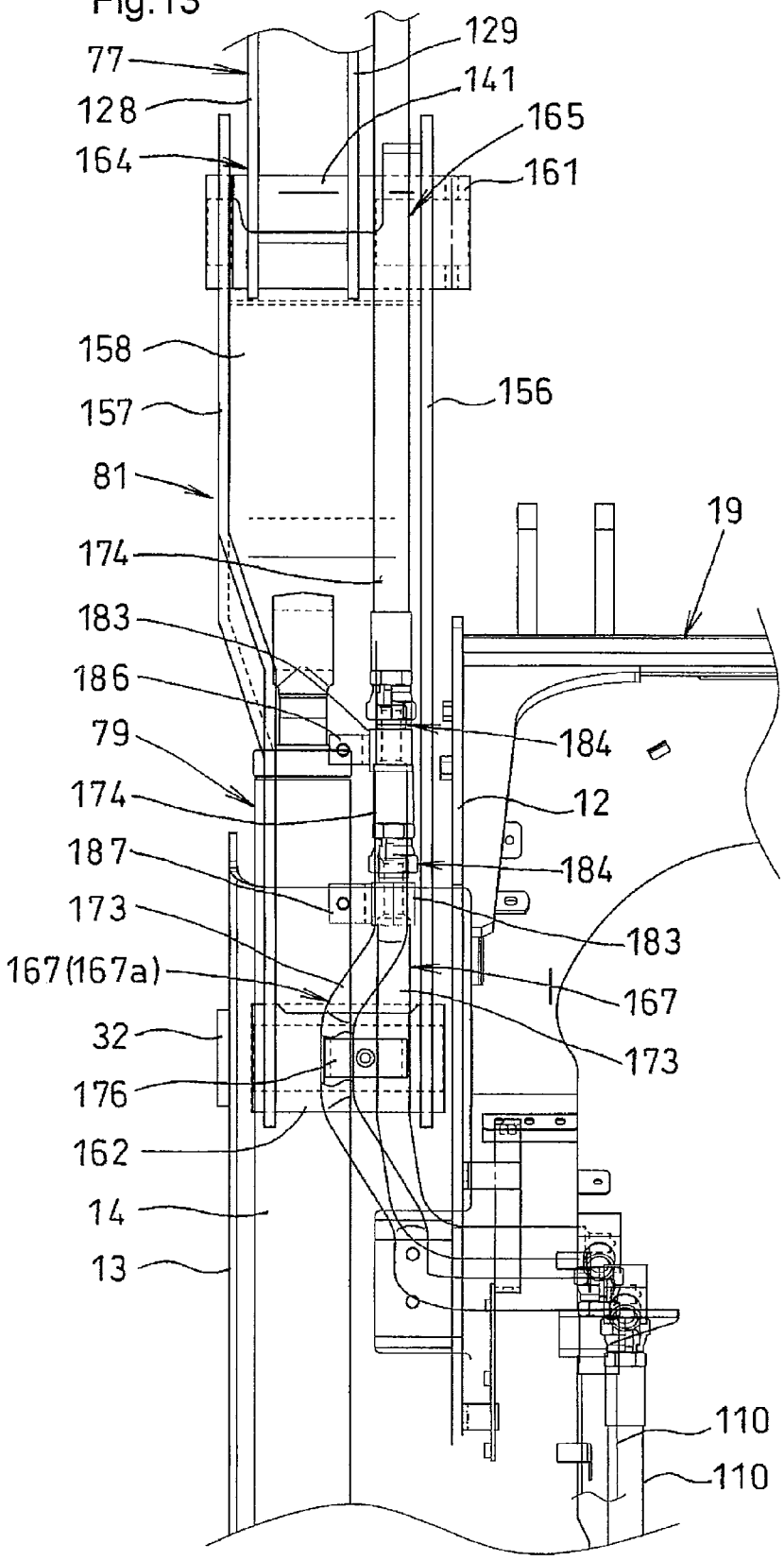
FIG. 13 is a rear view in the vicinity of the hydraulic pipe arrangement.
Figure 14:
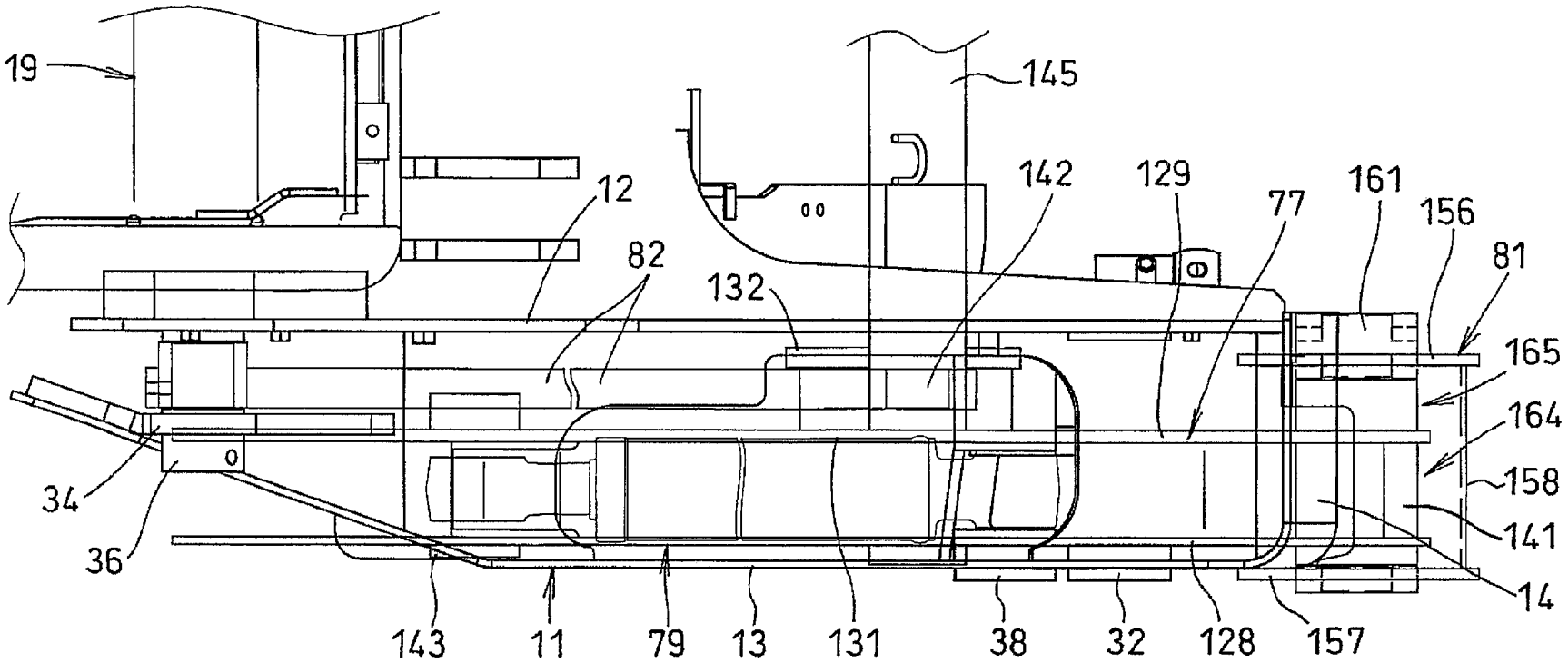
FIG. 14 is a plan view of portions of a support frame, the first lift link and the arm.

Further, as shown in FIG. 13, the upper free end side of each of the right/left first lift links 81 have wider width, so as to bulge laterally outward of the lower base portion. The base side of each of the right/left arms 77 is supported at a position closer to the outside in the transverse direction relative to the upper free end portion of the corresponding first lift link 81. Between the link inner wall 156 of the first lift link 81 and an internal side face of the base portion of the arm 77, a hose accommodation space 165 is formed. In other words, the base portion of the arm 77 is displaced offset laterally outward from the lower base portion of the first lift link 81. The hose accommodation space 165 is formed in each of the right/left first lift links 81.

As a result, as compared with a spacing distance of the lower base portions of the right/left first lift links 81 or the spacing distance of the right/left support frames 11, it is possible to make a spacing distance of the base portions of the right/left arms 77 larger. Also with this configuration, the transverse width of the cabin 4 is adequately secured, enhancing the comfort of the cabin 4.

(Arm Cylinder)

As shown in FIGS. 9, 11 and 18, the upper tip end side of the arm cylinder 79 is inserted between the outer wall 128 and inner wall 129 of the base portion of the arm 77, and the upper cylinder shaft 92 which has been inserted into the third connection boss 143 is further inserted into the upper tip end side of the arm cylinder 79, to thereby swingably connect the upper tip end side of the arm cylinder 79 to the base portion of the arm 77 by the upper cylinder shaft 92.

(Second Lift Link)

The free end side of the second lift link 82 is inserted between the elongating mounting wall 131 and the inner bracket 132, and the second arm shaft 89 is inserted from the second connection boss 142 into the free end side of the second lift link 82, to thereby swingably connect the free end side of the second lift link 82 to the base portion of the arm 77 by the second arm shaft 89. With this configuration, the base portion of the arm 77 is supported swingably in the vertical direction about the second arm shaft 89 on the free end portion of the second lift link 82, at a position frontward of the first arm shaft 88.

The second lift link 82 is disposed inward in the transverse direction relative to the arm cylinder 79, and when seen from the lateral side, the arm cylinder 79 and the second lift link 82 are allowed to cross each other.

(Stopper Mechanism)

As shown in FIGS. 1-3 and 5, between the front end portion of each of the right/left arms 77 and a front end portion of the body frame, a stopper mechanism 201 is provided, and in the state in which the arm cylinder 79 is contracted and the arm 77 is lowered, a rearward stress from the arm (working implement) 78 acting on a pair of the right/left arms 77 is received by the body frame 1. The stopper mechanism 201 includes: a pair of right/left stoppers 202 protruding rearward from the front connecting member 145; and a pair of right/left acceptors 203 protruding frontward from a front wall of the body frame 1. When the arm 77 is brought to the lowermost state, the right/left stoppers 202 come into contact with or are placed in the vicinity of the right/left acceptors 203, respectively, from a front side.

(Working Implement and Hydraulic Pipe Arrangement)

Between the front end portions of the arms 77, the bucket 78*a* (the working implement 78) is connected swingably about a shaft 97 to the front end connection boss 125 through a pair of right/left brackets 95. The bucket 78*a* is supported swingably about the support shaft 97 to the tip end portions of the arms 77 through the brackets 95. Between the brackets 95 of the bucket 78 and respective intermediate portions on the tip end side of the arms 77, a pair of the right/left hydraulic actuators 98 (the dump/tilt actuator 98*a*) each formed of a double-acting hydraulic cylinder are disposed. The bucket 78 is configured to swing (perform scooping and dumping action) by the extension and contraction of the hydraulic actuator 98.

As indicated with a chain line in FIG. 1, a hydraulic pressure-driven attachment 78*b* (another working implement 78), such as grapple, hydraulic pressure-driven mower and hydraulic breaker, and the movable part actuator 98*b* for driving a movable part of the attachment 78*b*, instead of or in addition to the bucket 78*a* (the working implement 78), may be removably attached to the tip end portion of the arm 77. In addition, when the hydraulic pressure-driven attachment 78*b*, such as grapple, hydraulic pressure-driven mower and hydraulic breaker, instead of the bucket 78*a* (the working implement 78), is attached to the tip end portion of the arm 77, the dump/tilt actuator 98*a* may perform tilting and dumping action of the installed attachment 78*b*.

Therefore, two types of the hydraulic actuator 98 for actuating the working implement 78 (including the bucket 78*a*, and the attachment 78*b* attached to the tip end portion of the arm 77, instead of or in addition to the bucket 78*a*) are present: the dump/tilt actuator 98*a* for performing dumping and tilting action of the working implement 78; and the movable part actuator 98*b* for actuating the movable part of the working implement 78. As shown in FIG. 1, on an internal side face of the tip end portion of the left arm 77, a pair of service ports SP are provided which are configured to be connected to the movable part actuator 98*b*.

Figure 12:
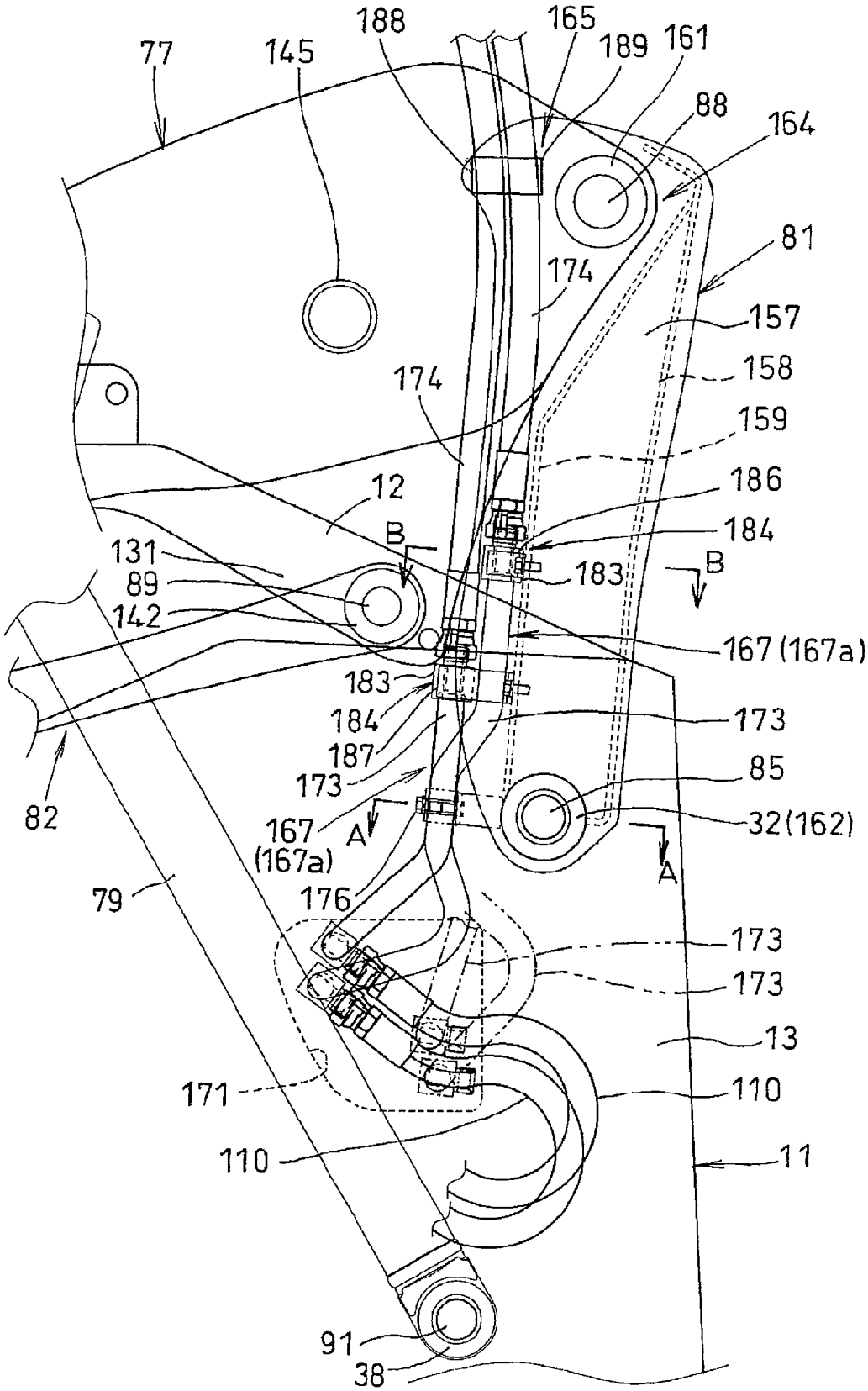
FIG. 12 is a side view in the vicinity of a hydraulic pipe arrangement.
Figure 17:
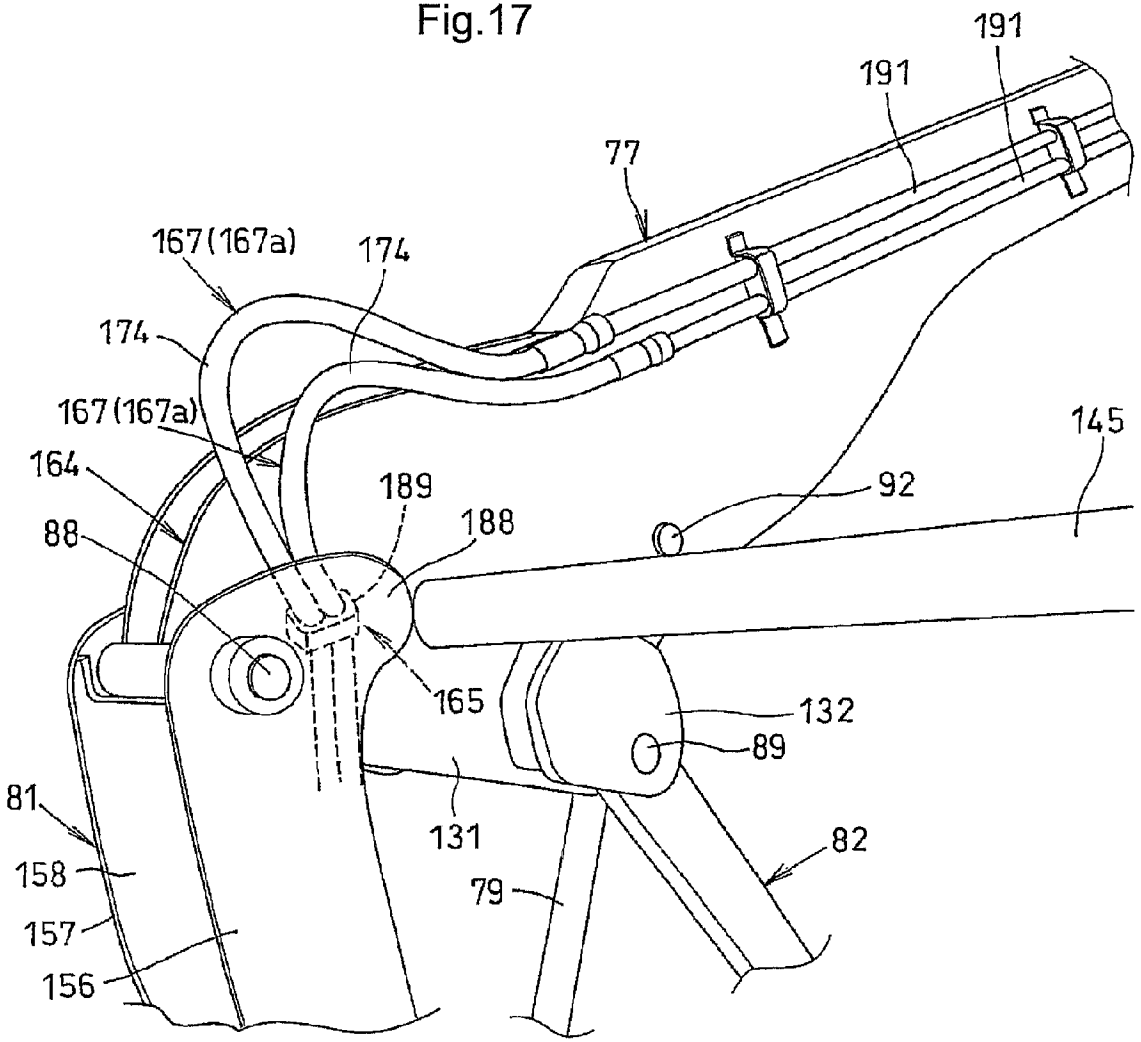
FIG. 17 is a perspective view of portions of the first lift link and the arm.

As shown in FIGS. 12, 13 and 17, a hydraulic pipe arrangement 167 (a left hydraulic pipe arrangement 167*a* and a right hydraulic pipe arrangement 167*b* (not shown)) configured to be connected to the hydraulic actuator 98 (98*a*, 98*b*) extends from a body frame 1 side to an arm 77 side. The hydraulic pipe arrangement 167 penetrates from inside of the inner wall 12 of the support frame 11 to the outside and extends to the arm 77 side.

The hydraulic pipe arrangement 167 includes: the movable part hydraulic pipe arrangement 167*a* for feeding and discharging the operating oil to and from the movable part actuator 98*b* of the attachment 78*b*; and the dump/tilt hydraulic pipe arrangement 167*b* (not shown) for feeding and discharging the operating oil to and from a pair of the right/left dump/tilt actuators 98. The movable part hydraulic pipe arrangement 167*a* is disposed inside the first lift link 81 on the left side, while the dump/tilt hydraulic pipe arrangement 167*b* is disposed inside the first lift link 81 on the right side.

Next, the left hydraulic pipe arrangement 167*a* will be described below. Since the right hydraulic pipe arrangement 167*b* has the same or similar structural arrangement to that of the left hydraulic pipe arrangement 167*a*, a duplicate description for the right hydraulic pipe arrangement 167*b* is omitted. In addition, FIGS. 12 and 13 depict the left hydraulic pipe arrangement 167*a* having two or four pipes, which include those for feeding and those for returning. A pair of the hydraulic pipe arrangements 167*a* run frontward of the first arm shaft 88 and first link shaft 85, and at the same time, are disposed in the hose accommodation space 165 of the first lift link 81 on the left side.

In the first lift link 81, a pair of the hydraulic pipe arrangements 167*a* are disposed at a position closer to the link inner wall 156 spaced apart from the link outer wall 157 and run in the vertical direction. As shown in FIGS. 12, 13 and 17, an upper portion side of a pair of the hydraulic pipe arrangements 167*a* is disposed along an inner face of the link inner wall 156 of the first lift link 81, and at the same time, along an internal side face of the arm 77 from an upper end of the first lift link 81. In addition, a pair of the hydraulic pipe arrangements 167*a* extend upward from the upper end of the first lift link 81, curve into an arc shape in a vertical plane extending in the front-rear direction and are disposed linearly along the internal side face of the arm 77 from a base end side of the arm 77 toward the tip end side of the arm 77.

A lower portion side of a pair of the hydraulic pipe arrangements 167*a* is bent inward in the transverse direction below the first lift link 81 on the left side, inserted into the body frame 1 through an opening 171 in the inner wall 12 of the support frame 11, and connected to a control valve 217 provided inside the body frame 1.

Each of the hydraulic pipe arrangements 167*a* on a lower base side of the first lift link 81 is a metal pipe portion 173 formed of a metal pipe having stiffness, while each of the hydraulic pipe arrangements 167*a* on the upper free end side of the first lift link 81 is a hydraulic hose portion 174 formed of a flexible hydraulic hose. The hydraulic hose portion 174 extends upward from the upper end of the first lift link 81 and is disposed along the internal side face of the arm 77, while a lower end side of the metal pipe portion 173 of the hydraulic pipe arrangement 167*a* is bent inward in the transverse direction, and inserted into the body frame 1 through the opening 171 in the inner wall 12 of the support frame 11, and the metal pipe portion 173 is connected to the control valve 217 provided inside the body frame 1 through a hydraulic hose 110, inside the body frame 1.

Figure 15:
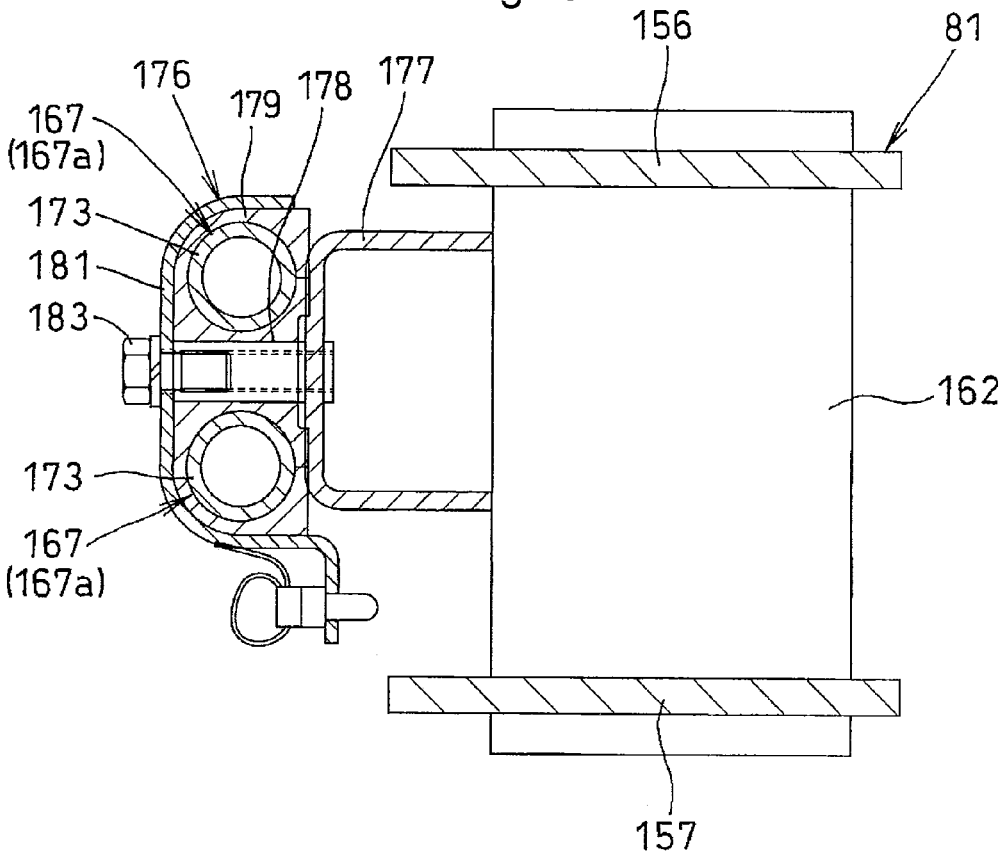
FIG. 15 is a view in section taken along a line A-A in FIG. 12.

As shown in FIGS. 12 and 15, the lower support boss 162 is provided with a clamp member 176 configured to clamp an intermediate portion of the metal pipe portion 173 of the hydraulic pipe arrangement 167*a*. The clamp member 176 includes: a mounting stage 177 having a squared U-shape protruding from the lower support boss 162; a screw cylinder body 178 fixedly installed to the mounting stage 177; a cushion material 179 into which a pair of the hydraulic pipe arrangements 167*a* are inserted; a press plate 181 configured to press a pair of the hydraulic pipe arrangements 167*a* to the mounting stage 177 through the cushion material 179; and a bolt 183 configured to be screwed with the screw cylinder body 178 to press the press plate 181 to the screw cylinder body 178. The clamp member 176 is configured to clamp a pair of the hydraulic pipe arrangements 167*a* each at the intermediate portion of the metal pipe portion 173.

Figure 16:
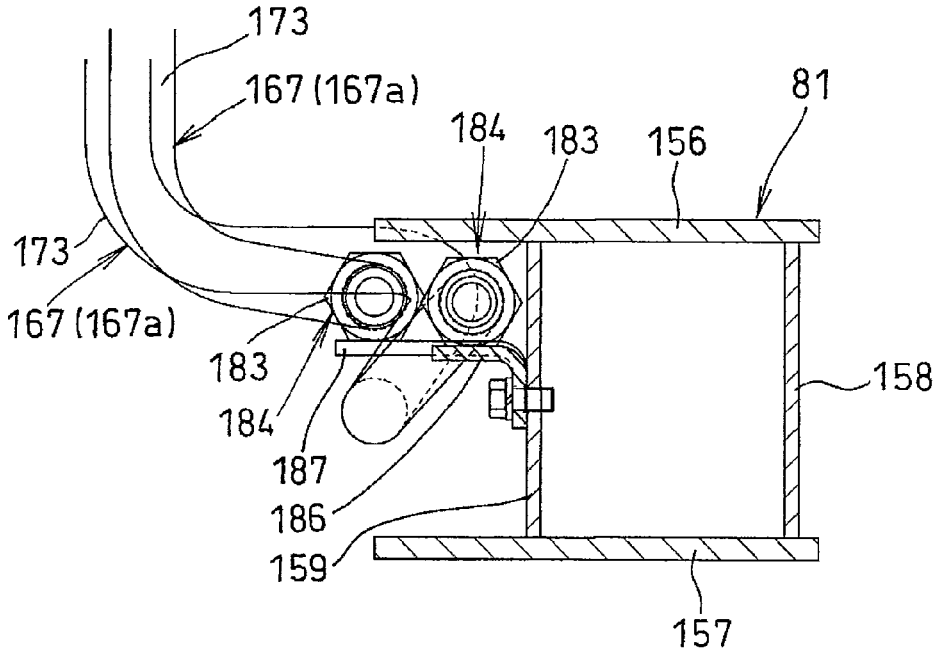
FIG. 16 is a view in section taken along a line B-B in FIG. 12.

As shown in FIGS. 12 and 16, on an upper end portion of the metal pipe portion 173 of each of the hydraulic pipe arrangements 176*a*, a joint portion 184 having a nut body 183 is provided, and an L-shaped upper support stay 186 and an L-shaped lower support stay 187 arranged at an interval in the vertical direction are attached to the link intermediate portion connection wall 159 of the first lift link 81, using a fastener, such as bolt. The nut body 183 of the joint portion 184 for the hydraulic pipe arrangement 176*a* is fixedly installed on each of the upper support stay 186 and the lower support stay 187, to thereby fix an upper end side of the metal pipe portion 173 of the hydraulic pipe arrangement 176*a* to the first lift link 81. The metal pipe portion 173 and the hydraulic hose portion 174 of the hydraulic pipe arrangement 176*a* are removably connected to each other at the joint portion 184.

As shown in FIGS. 12 and 17, in an upper end portion of the link inner wall 156 of the first lift link 81, a front projection 188 is provided which protrudes frontward and is configured to restrict lateral sway of the hydraulic hose portion 174, and on the inner face of the link inner wall 156 in the hose accommodation space 165, a clamp 189 configured to fix the hydraulic hose portion 174 is provided.

As shown in FIG. 17, a pair of hydraulic pipe arrangements 191 each formed of a metal pipe are fixed to the internal side face of the arm 77 using the clamp and disposed in the tip end portion of the arm 77, and then connected to the respective service ports SP. The hydraulic hose portions 174 of a pair of the hydraulic pipe arrangements 167*a* are connected to the respective hydraulic pipe arrangements 191 through joints. Therefore, the control valve 217 on the body frame 1 side and a pair of the service ports SP on the tip end side of the aim 77 are connected through a pair of the hydraulic pipe arrangements 167 and the like, and when the attachment 78*b* is attached to the tip end portion of the arm 77 instead of or in addition to the bucket 78*a*, the attachment 78*b* is configured to be actuated from a control valve 217 side, by feeding and discharging the operating oil to and from a driving portion attachment 98*b* of the attachment 78*b*.

According to the configuration of the present embodiment, the hydraulic pipe arrangement 167 can be protected between the link outer wall 157 and the link inner wall 156 of the first lift link 81. Portions of the hydraulic pipe arrangement 167 exposed outside are reduced, and the hydraulic pipe arrangement 167 disposed from the body frame 1 side to the arm 77 side is not likely to be damaged. In addition, since the hydraulic pipe arrangement 167 is covered between the link outer wall 157 and the link inner wall 156 of the first lift link 81, an appearance of a rear portion of the loader work machine can be prevented from being deteriorated, which may otherwise be caused by the hydraulic pipe arrangement 167. Further, since the movement of the hydraulic pipe arrangement 167 can be restricted between the link outer wall 157 and the link inner wall 156 of the first lift link 81, a number of the clamps for fixing the hydraulic pipe arrangement 167 can be reduced. Since the hose accommodation space 165 is provided in which the hydraulic hose portion 174 can be disposed linearly in the vertical direction, interference or friction between the hydraulic pipe arrangement 167 and the base portion of the arm 77 can be prevented, and the hydraulic pipe arrangement 167 can be easily and securely disposed in the vertical direction in the first lift link 81.

In addition, the upper portion side of the hydraulic pipe arrangement 167 is disposed along the inner face of the link inner wall 156 of the first lift link 81, and at the same time, along the internal side face of the arm 77 from the upper end of the first lift link 81. Therefore, even when the arm 77 is lifted and lowered, a portion of the hydraulic pipe arrangement 167 that protrudes upward is not likely to sway in the transverse direction, and the hydraulic pipe arrangement 167 can be prevented from hitting or rubbing against the first lift link 81 and the arm 77.

The lower portion side of the hydraulic pipe arrangement 167 is bent inward in the transverse direction below the first lift link 81, inserted into the body frame 1 through the opening 171 in the inner wall 12 of the support frame 11, and connected to the control valve 217 provided inside the body frame 1. Therefore, the hydraulic pipe arrangement 167 extending downward from the first lift link 81 can be guided into the body frame 1 with the shortest distance, and thus the hydraulic pipe arrangement 167 can be set as short as possible.

The upper free end side of each of the right/left first lift links 81 have wider width, so as to bulge laterally outward of the lower base portion, and the base side of each of the right/left arms 77 is supported at a position closer to the outside in the transverse direction relative to the upper free end portion of the corresponding first lift links 81, so that the base side of the arm 77 is positioned outward in the transverse direction relative to the hydraulic pipe arrangement 167 in the upper free end side of the first lift link 81. Therefore, a transverse width of the hose accommodation space 165 becomes larger, and even when a pair of the arms 77 are swung in the vertical direction, interference between the base side of each of the right/left arms 77 and the hydraulic pipe arrangement 167 of the upper free end side of the first lift link 81 is more effectively prevented.

As described above, at least the upper portion side of the hydraulic pipe arrangement 167 is formed of the flexible hydraulic hose portion 174. In the upper end portion of the link inner wall 156 of the first lift link 81, the front projection 188 is provided which protrudes frontward and is configured to restrict lateral sway of the hydraulic hose portion 174, and on the inner face of the link inner wall 156 in the hose accommodation space 165, the clamp 189 configured to fix the hydraulic hose portion 174 is provided. Therefore, the upper portion side of the hydraulic pipe arrangement 167 can be prevented in advance from being bit or abraded by a portion of the first arm shaft 88 of the first lift link 81. It should be noted that all of the hydraulic pipe arrangement 167 may be formed of flexible hydraulic hose.

There are two types of the hydraulic actuator 98 for actuating the working implement 78. One is the dump/tilt actuator 98*a* for performing dumping and tilting action of the working implement 78; and the other is the movable part actuator 98*b* for actuating the movable part of the working implement 78. The hydraulic pipe arrangement 167 includes: the dump/tilt hydraulic pipe arrangement 167*a* for feeding and discharging the operating oil to and from the dump/tilt actuator 98*a*; and the movable part hydraulic pipe arrangement 167*b* for feeding and discharging the operating oil to and from the movable part actuator 98*b*. The dump/tilt hydraulic pipe arrangement 167*a* is disposed in one of the right/left first lift links 81, and the movable part hydraulic pipe arrangement 167*b* is disposed in the other of the right/left first lift link 81. Therefore, the dump/tilt hydraulic pipe arrangement 167*a* and the movable part hydraulic pipe arrangement 167*b* are separately assigned to the right/left first lift links 81, and connection to the dump/tilt hydraulic pipe arrangement 167*a* for feeding and discharging the operating oil to and from the dump/tilt actuator 98*a* and the connection to the movable part hydraulic pipe arrangement 167*b* for feeding and discharging the operating oil to and from the movable part actuator 98*b* can be performed easily and securely without error.

(Arrangement of Shafts)

As shown in FIGS. 1 and 2, positional relationships among the first link shaft 85, the second link shaft 86, the first arm shaft 88 and the second arm shaft 89 are set so that nearly an entirety of the first lift link 81 is retained frontward of a rear end of the vehicle body of the loader work machine (rear end of the rear hood cover 40) in a whole range of lifting and lowering action of the arm 77 from the lowermost state to the uppermost state. In other words, the positional relationships among the first link shaft 85, the second link shaft 86, the first arm shaft 88 and the second arm shaft 89 are set so that an upper portion of the first lift link 81 is placed frontward of the rear end of the vehicle body of the loader work machine in the whole range of lifting and lowering action of the arm 77.

Accordingly, during a whole process of lifting and lowering the arm 77, the first lift link 81 never protrudes rearward of the rear end of the vehicle body of the loader work machine to a large extent, and during a working operation or the like, the first lift link 81 can be prevented from hitting and interfering with an object rearward of the loader work machine. Therefore, when the loader work machine is backed up, the first lift link 81 can be prevented from coming into contact with the object rearward. Further, since the first lift link 81 never protrudes rearward to a large extent, workability in a small space is enhanced. Moreover, if the first lift link 81 protrudes rearward to a large degree, an obliquely rearward view is hindered by the first lift link 81 and becomes poor. However, with the present configuration, the first lift link 81 never protrudes rearward to a large degree, and the obliquely rearward view becomes excellent.

When the arm 77 is lifted and lowered and the second link shaft 86, the first arm shaft 88, and the second arm shaft 89 are aligned on a single line, the first lift link 81 is inclined rearward to the largest degree as indicated with a chain line in FIG. 2. The first arm shaft 88 is configured to be positioned frontward of the rear end of the vehicle body (rear end of the rear hood cover 40) of the truck loader under this circumstance. When the upper free end side of the first lift link 81 is swung rearward to the largest degree within the whole range of the lifting and lowering action of the arm 77, a position in the front-rear direction of the upper portion of the first lift link 81 nearly coincides with a position of the rear end of the vehicle body (rear end of the rear hood cover 40) of the truck loader.

In this manner, in the state in which the upper free end side of the first lift link 81 is swung rearward to the largest degree, even when the first lift link 81 protrudes rearward of the rear end of the vehicle body of the truck loader, the upper portion of the first lift link 81 only slightly protrudes rearward, and during a working operation or the like, the first lift link 81 is not likely to interfere.

It is configured that, when the arm 77 is in the lowermost state, the second arm shaft 89 is positioned on a first link shaft 85 side relative to a line segment connecting the second link shaft 86 and the first arm shaft 88, and at the same time, a line segment connecting the second link shaft 86 and the second arm shaft 89 and a line segment connecting the first arm shaft 88 and the second arm shaft 89 intersect one another at an obtuse angle. With this configuration, when the arm cylinder 79 is contracted and the arm 77 is lowered, after the first lift link 81 is swung rearward about the first link shaft 85, the first lift link 81 is further swung forward to some degree.

Accordingly, the upper free end side of the first lift link 81 swung rearward to the largest degree only in the middle of the lifting and lowering action of the arm 77. Though the first lift link 81 protrudes rearward of the rear end of the vehicle body of truck loader, it protrudes only during a brief period of time in the middle of the lifting and lowering action of the arm 77, and also from this point of view, the first lift link 81 is not likely to interfere during a working operation.

The first lift link 81 is made longer than the second lift link 82, and a distance between the first link shaft 85 and the first arm shaft 88 is set longer than a distance between the second link shaft 86 and the second arm shaft 89. A distance between the first arm shaft 88 and the second arm shaft 89 is set shorter than the distance between the first link shaft 85 and the first arm shaft 88. In addition, the second link shaft 86 is disposed frontward of the drive shaft 71 of the traveling device 3.

As shown in FIGS. 2, 9 and 13, it is configured that, when the arm 77 is in the lowermost state, the first lift link 81 is inclined upward and rearward, and the first arm shaft 88 is positioned rearward of the first link shaft 85. It is also configured that the first link shaft 85 is positioned rearward of the lower cylinder shaft 91.

In the embodiment described above, each of the right/left traveling devices 3 is formed of the crawler track traveling device in which the crawler track 70 is wound around the driven wheels 68 and the drive wheel 69. Alternatively, instead of this, each of the right/left traveling devices 3 may be formed of a front wheel tire and a rear wheel tire.

In the embodiment described above, the rear connecting member 146 and the cabin 4 are spaced apart from each other in the front-rear direction, in order to prevent interference between the cabin 4 in the tilted state and the rear connecting member 146, in the state in which the arm 77 is lowered. Alternatively, instead of this, in the state in which the arm 77 is lowered, the back side of the cabin 4 in the tilted state may come into contact with the rear connecting member 146, to thereby retain the cabin in the tilted state.

In the embodiment described above, grease is applied to the connecting portions of the arm 77 with the first lift link 81, the arm cylinder 79 and the second lift link 82. Alternatively, instead of this, lubricant other than grease may be applied to the connecting portions of the arm 77 with the first lift link 81, the arm cylinder 79 and the second lift link 82.

In the embodiment described above, the track frame 73 of each of the right/left traveling devices 3 is attached to the corresponding side wall 7 of the frame main body 9 by welding in a unified manner. Alternatively, instead of this, the track frame 73 of each of the right/left traveling devices 3 may be detachably attached to the corresponding side wall 7 of the frame main body 9, using a fastener, such as bolt nut.

(Another Embodiment)

Another embodiment of the loader work machine according to the present invention will be described next with reference to the drawings. With respect to components corresponding to those in the foregoing embodiment, description thereof will not be made again. In the following embodiment, the same reference character denotes the component having the same nomination in the foregoing embodiment.

Referring to FIGS. 21-24, the body frame 1 formed of iron plate or the like includes: the frame main body 9 having the bottom wall 6, a pair of the right/left side walls 7 and the front wall 8; and a pair of the right/left support frames 11. A pair of the right/left support frames 11 are connected and welded to the rear end side of the frame main body 9, which is formed in a box shape including the bottom wall 6, a pair of the right/left side walls 7, and the front wall 8, with an upper side opened. The upper rim of the rear end portion of each of the right/left side walls 7 has an arc shape which is gradually inclined downward and rearward. On the upper end of each of the right/left side walls 7, the bent rim portion 7*a* protruding laterally outward is provided. On the upper end of the front wall 8, the bent rim portion 8*a* protruding rearward is provided, on each of lateral sides of the bent rim portion 8*a*, the connecting piece 8*b* extends outward, and the connecting piece 8*b* is welded to the front end of the corresponding bent rim portion 7*a* of the side wall 7.

Each of the right/left support frames 11 includes: the inner wall 12; the outer wall 13; and the frame connecting wall 14 connecting the rear end of the inner wall 12 and the rear end of the outer wall 13, and has a squared C-shape as a whole. The mounting plate 16 curved in an arc shape is disposed on the upper end of the rear end portion of the side wall 7 in such a manner that the mounting plate 16 and the side wall 7 are arranged in a T-shape or L-shape, and the mounting plate 16 is welded to the side wall 7. The front end portion of the mounting plate 16 is overlapped with and welded to the rear end portion of the bent rim portion 7*a* of the side wall 7. The outer side portion of the mounting plate 16 protrudes outward from the upper end of the side wall 7, and the bent rim portion 7*a* of the side wall 7 and the mounting plate 16 constitute the fender 17 configured to cover the upper side and the rear side of the traveling device 3. The front lower end of each of the inner wall 12 and the outer wall 13 of each of the right/left support frames 11 is welded to the mounting plate 16. With this configuration, each of the right/left support frames 11 is connected and fixed to the side wall 7 of the body frame 1 through the mounting plate 16. The upper portion of each of the inner wall 12, the outer wall 13 and the frame connecting wall 14 of the support frames 11 protrudes above the side wall 7.

The upper portions of the inner wall 12 of the right/left support frames 11 are connected to each other through the transversal connecting member 19. The transversal connecting member 19 includes: the gate-shaped front wall plate 20; and the upper wall plate 21 protruding rearward from the upper end of the front wall plate 20. The rear portion 21*a* of the upper wall plate 21 is inclined downward and rearward. On both lateral end portions of the upper wall plate 21 of the transversal connecting member 19, a pair of the right/left support brackets 22 protruding upward are provided. Each of the right/left support brackets 22 has a pair of right/left support plates 23, and each of the support plates 23 has the mounting hole 24 on the front side and the locking hole 25 on the rear side, both penetrating in the transverse direction.

In the intermediate portion of the rear portion of the bottom wall 6 of the frame main body 9, a pair of the right/left support bases 26 protruding upward are provided. On the rear end portion of the frame main body 9, a connection reinforcing plate 27 extends along the rear end of the bottom wall 6. The connection reinforcing plate 27 is connected and welded to a pair of the right/left support frames 11, and is welded to the rear end portion of the bottom wall 6 of the frame main body 9. The lower ends of the right/left support frames 11 are connected to each other through the connection reinforcing plate 27 and a lower connection plate 28. The reinforcing plate 27 and the lower connection plate 28 are welded to each other, the connection reinforcing plate 27 is connected and welded to the bottom wall 6 of the body frame 1, both end portions of the connection reinforcing plate 27 and the lower connection plate 28 are welded to the respective inner walls 12 of a pair of the support frames 11 or the frame connecting walls 14, and a pair of the right/left support frames 11 are connected to the bottom wall 6 through the connection reinforcing plate 27 and the lower connection plate 28.

In the upper rear end portion of each of the right/left support frames 11, the first mounting boss 32 having the mounting hole is provided between the inner wall 12 and the outer wall 13. On the upper front end portion of the outer wall 13 of each of the right/left support frames 11, the stay member 34 protruding rearward is provided. Between the stay member 34 and the inner wall 12, the second mounting boss 36 having the mounting hole is provided. In the lower end portion of each of the right/left support frames 11, the third mounting boss 38 having the mounting hole is provided between the inner wall 12 and the outer wall 13.

Figure 22:
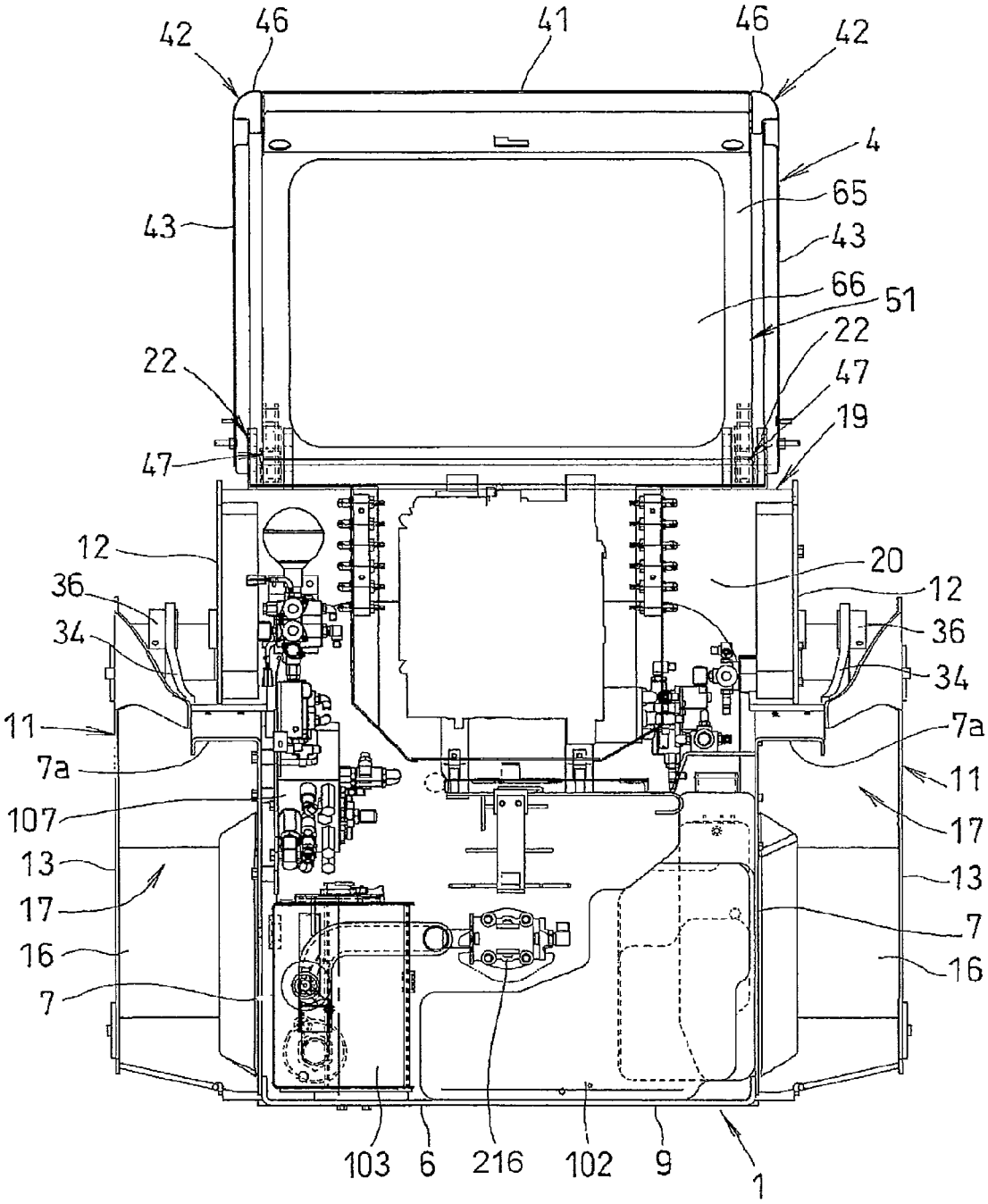
FIG. 22 is a front view in vertical section of the loader work machine according to another embodiment.

As shown in FIG. 22, on an upper side of a back wall body 51 of the cabin 4, a window frame 65 is provided. The window frame 65 is fixed between the rear support pole portions 45 of the right/left side frame members 42 of the cabin 4 by welding or the like, and a rear glass 66 is attached to the window frame 65.

Figure 19:
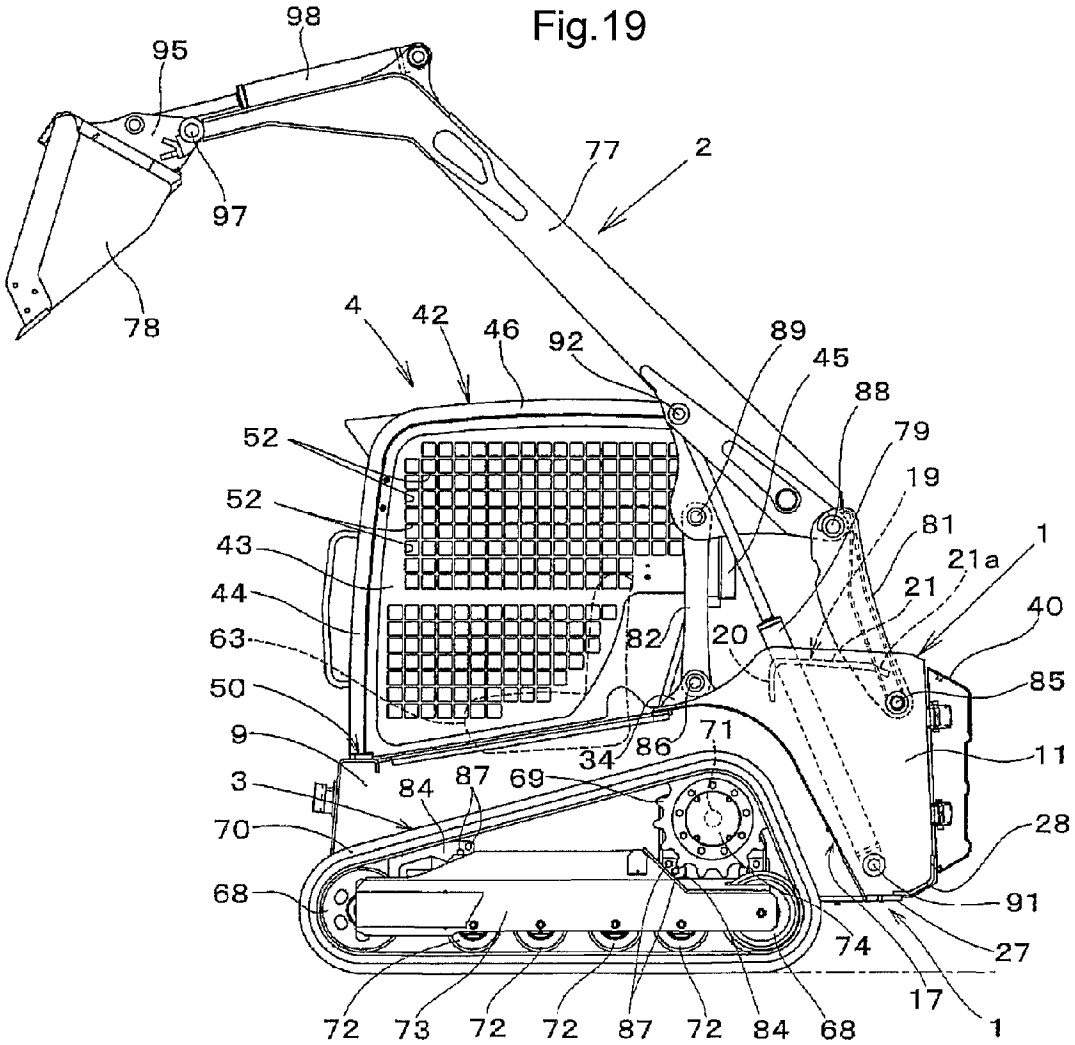
FIG. 19 is a side view of a loader work machine according to another embodiment with an arm lifted.
Figure 20:
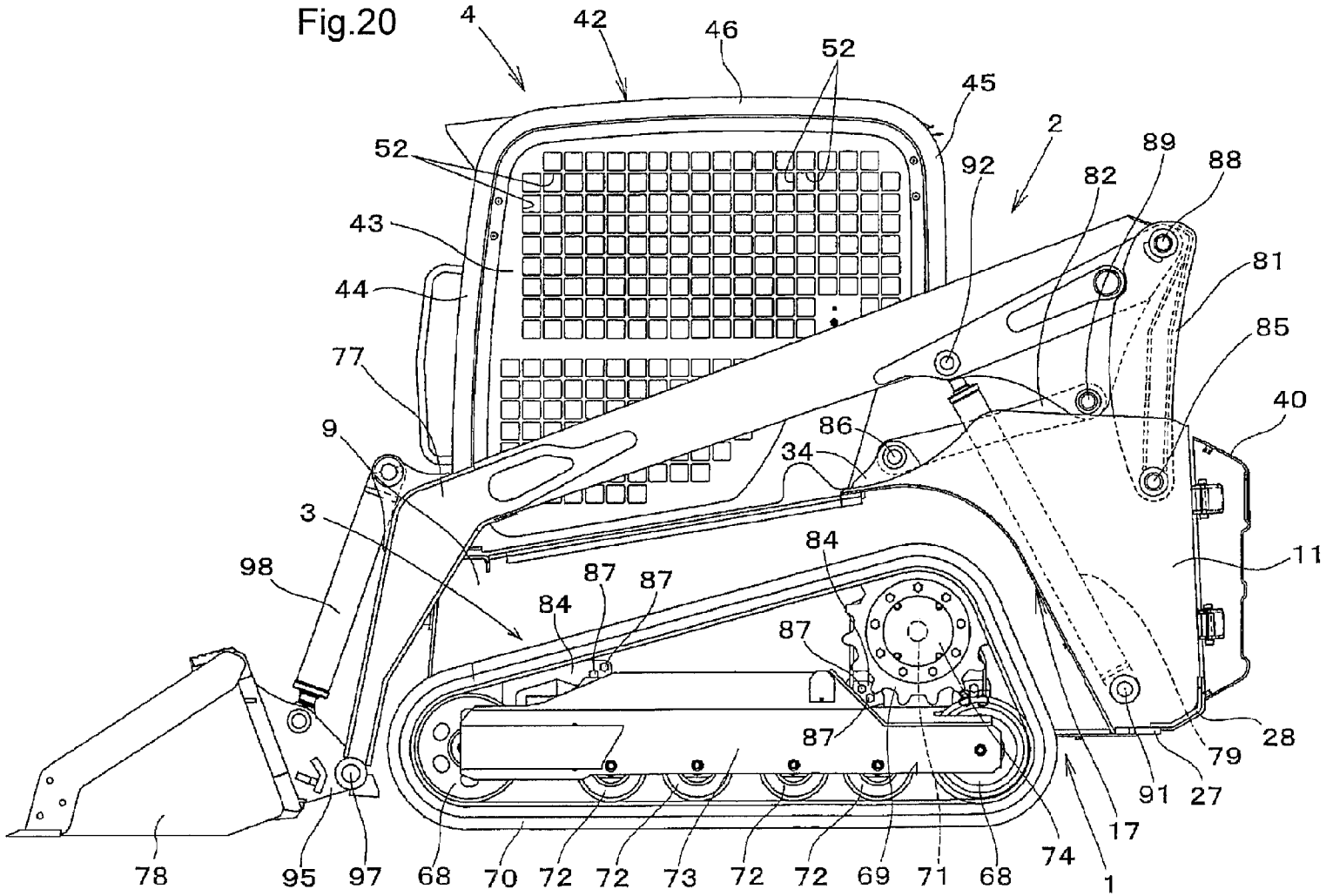
FIG. 20 is a side view of the loader work machine according to another embodiment with the arm lowered.
Figure 24:
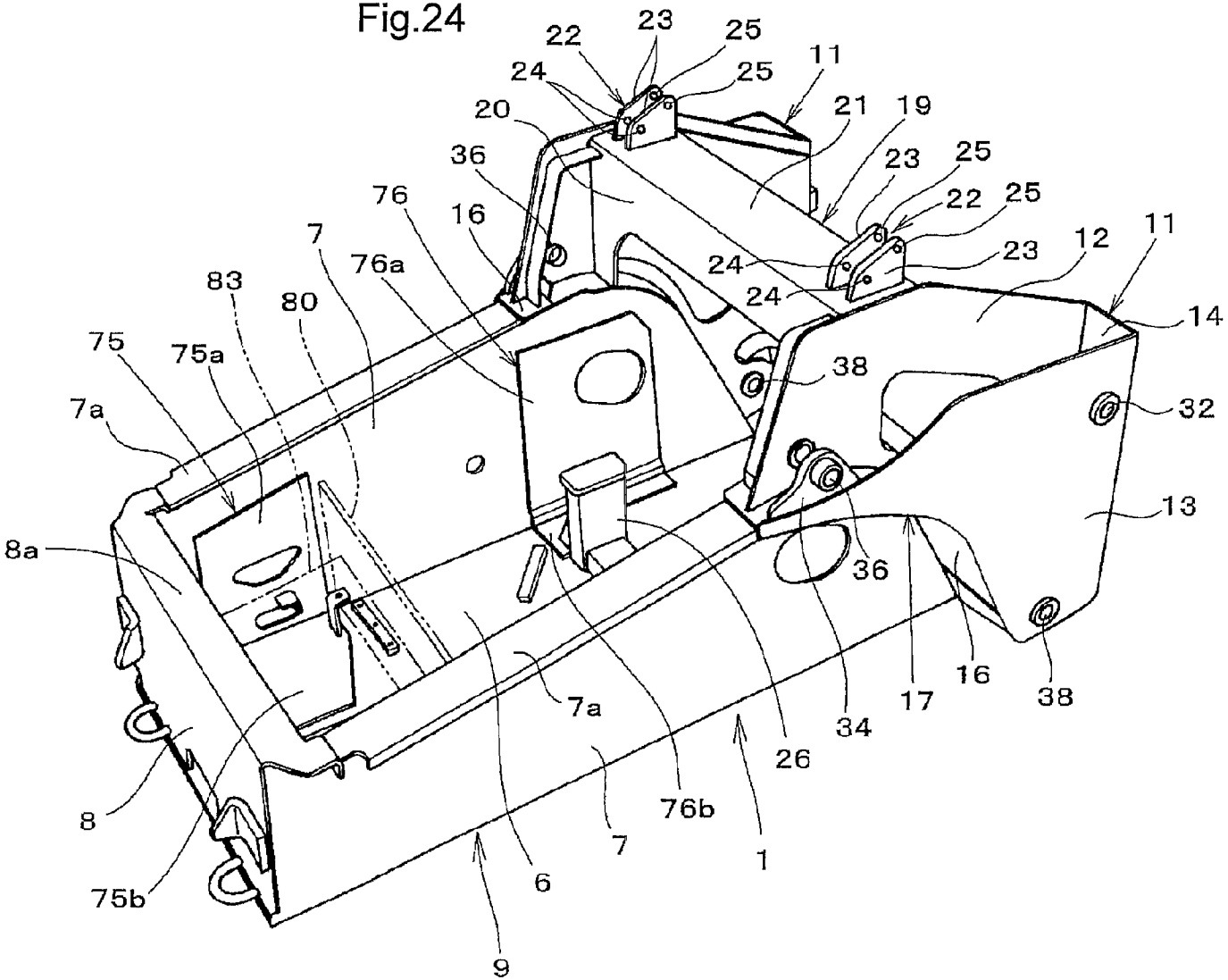
FIG. 24 is a perspective view of a body frame according to another embodiment seen from above and a front side.

Referring to FIGS. 19, 20 and 24, to an outside of each of the right/left side walls 7 of the body frame 1, front and rear end portions of the track frame 73 of the traveling device 3 are fixed through mounting plates 84 using fasteners 87, such as bolt. On an inner face of each of the right/left side walls 7 of the body frame 1, at positions corresponding to the position of the fixed track frame 73, a front reinforcing plate 75 and a rear reinforcing plate 76 are overlapped with and welded to the inner face.

Each of the right/left front reinforcing plates 75 includes a standing wall 75*a* that overlaps with the inner face of the side wall 7, and a lower wall 75*b* that overlaps with an upper face of the bottom wall 6, and has an L-shape as a whole. The lower walls 75*b* of the right/left front reinforcing plates 75 are spaced apart in the transverse direction, and a portion of the bottom wall 6 of the frame main body 9 between a pair of the lower walls 75*b* serves as a channel for discharging dust, operating oil or the like. Like the front reinforcing plate 75, each of the right/left rear reinforcing plates 76 includes a standing wall 76*a* that overlaps with the inner face of the side wall 7, and a lower wall 76*b* that overlaps with the upper face of the bottom wall 6, and has an L-shape as a whole.

Figure 21:
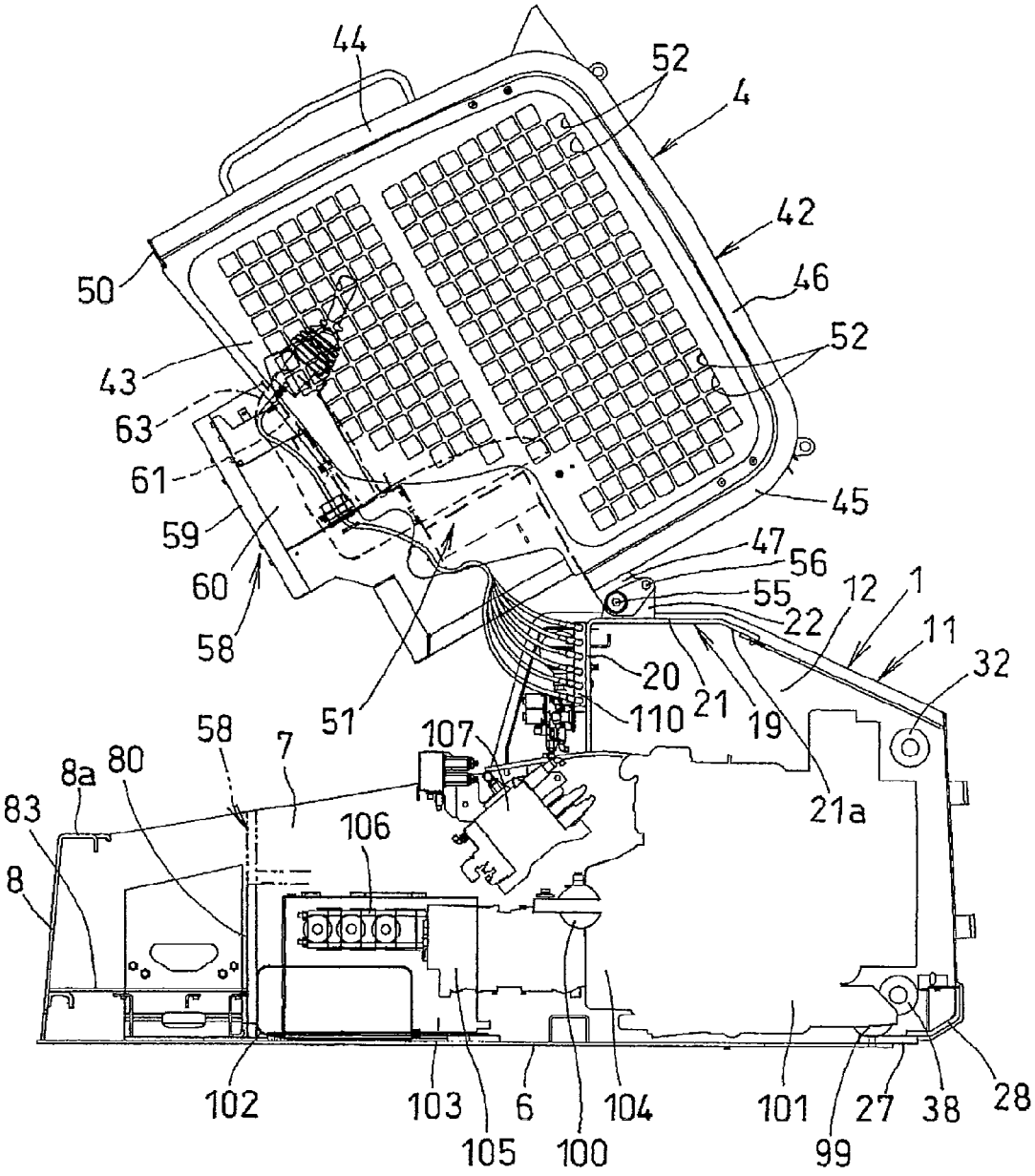
FIG. 21 is a side view in vertical section of the loader work machine according to another embodiment.

As shown in FIGS. 21 and 24, the frame main body 9 is provided with a partition plate 80 that separates the front portion and the rear portion of the body frame 1. The partition plate 80 is removably inserted between a pair of the right/left side walls 7 of the frame main body 9.

To an upper rim portion or the like of the partition plate 80, a sealing member (not shown) is attached, and when the cabin 4 is swung to the mount position, the bottom wall body 58 of the cabin 4 comes into contact with the partition plate 80 from above through the sealing member. With the presence of the partition plate 80 and the bottom wall body 58 and back wall body 51 of the cabin 4, portions frontward of the back wall body 51 of the cabin 4 and the front portion of the body frame 1 are shielded from the rear portion of the body frame 1 on which the engine 101 is mounted (which will be described later). Frontward of the partition plate 80, a step 83 as a foot rest for the driver seated on the driver's seat 63 of the cabin 4 is provided.

Figure 23:
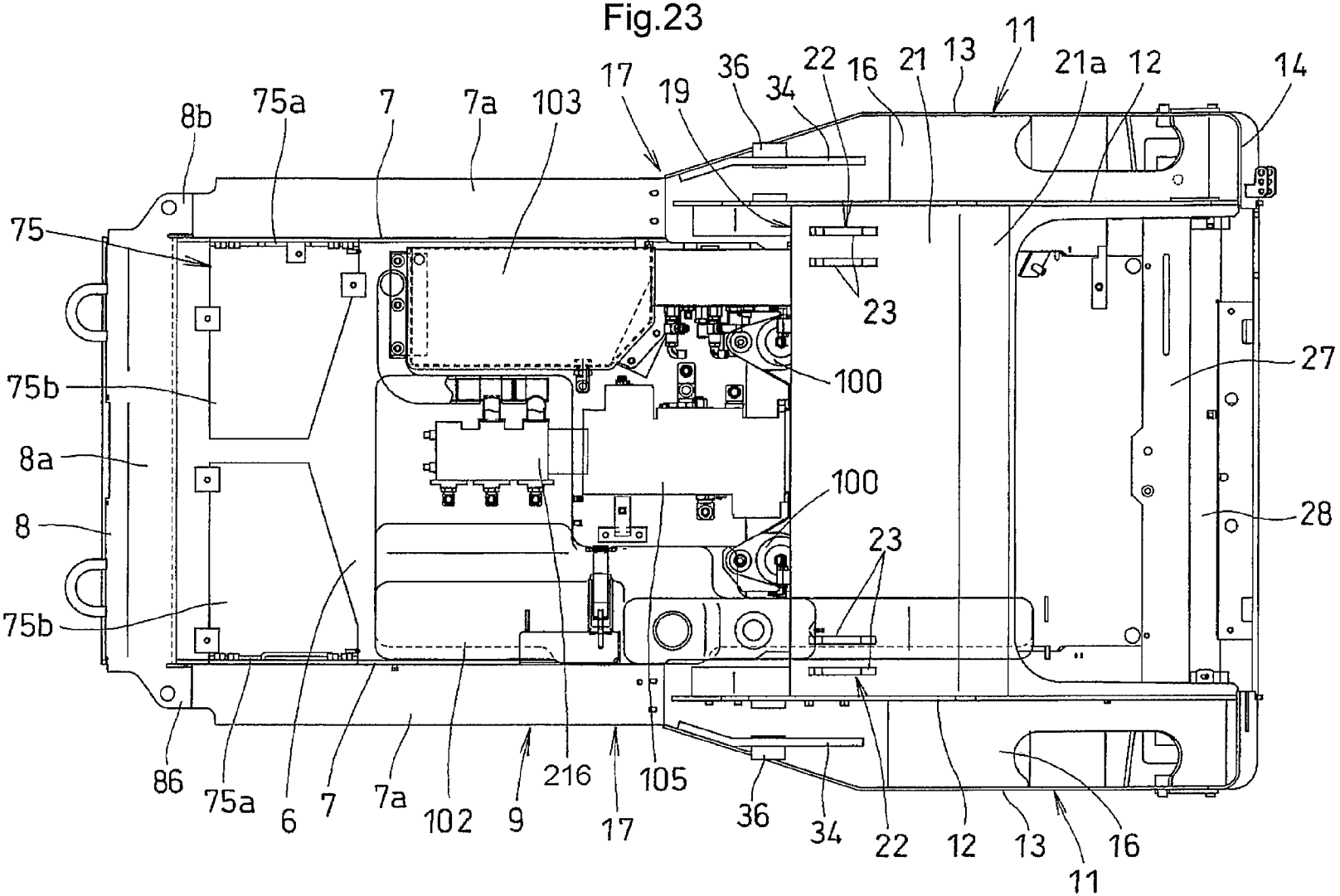
FIG. 23 is a plan view of the loader work machine according to another embodiment.

Referring to FIGS. 21-23, on the rear side above the bottom wall 6 of the body frame 1, the engine 101 is provided. On a front end side of the engine 101, a flywheel 104 is attached. The central portion in the transverse direction on the rear side of the engine 101 is set on and fixed to the connection reinforcing plate 27 through the anti-vibration member 99, and the right/left portions on the front side of the engine 101 are set on and fixed to the right/left support bases 26, respectively, through the corresponding anti-vibration member 100.

On a front side the bottom wall 6 of the body frame 1, a fuel tank 102 and an operating oil tank 103 are disposed. The fuel tank 102 is disposed immediately rearward of the partition plate 80, and by upward removing the partition plate 80 from the frame main body 9, the fuel tank 102 is allowed to slid frontward on the bottom wall 6 and to be upward removed from a front end portion of the frame main body 9.

By the power of the engine 101, the running hydraulic controller 215 performs feeding and discharging of the operating oil in the operating oil tank 103 to and from a pair of the right/left running motors 74 to thereby drive and control a pair of the right/left running motors 74. By inputting the power of the engine 101 through the running hydraulic controller 215, the gear pump 216 performs feeding and discharging of the operating oil in the operating oil tank 103 to and from the arm cylinders 79 and a bucket cylinder 98, through the work control valve 217. The work control valve 217 drive controls the arm cylinders 79 and the bucket cylinder 98 to thereby contract and extend the arm cylinders 79 and the bucket cylinder 98.

The body frame 1 includes the frame main body 9 having the bottom wall 6 and a pair of the right/left side walls 7 and the front wall 8, and a pair of the right/left support frames 11 which are connected and welded to the rear end side of the frame main body 9. Therefore, the entire body frame 1 can be formed in a unified manner without using a fastener, such as bolt nut, to thereby advantageously secure the strength of the entire body frame 1. In addition, in terms of the components of the body frame 1, no attention should be paid to loosening of the fastener, such as bolt nut, and damage in the mounting hole for bolt insertion. In addition, during the assembly of the body frame 1, a fastening step of bolt becomes unnecessary, leading to reduced number of steps in assembling the body frame 1. Accordingly, the entire body frame 1 can be easily manufactured.

The mounting plate 16 is disposed on the upper end of the rear end portion of the side wall 7 of the frame main body 9 between the inner wall 12 and the outer wall 13 of the support frame 11. Therefore, the inner wall 12 and the outer wall 13 of the support frame 11 can be easily and securely welded to the upper end of the rear end portion of the side wall 7, and the inner wall 12 and the outer wall 13 of the support frame 11 are firmly connected and fixed to the upper end of the rear end portion of the side wall 7 of the frame main body 9. Accordingly, the frame main body 9 and the support frame 11 can be easily unified.

Since the mounting plate 16 is disposed on the upper end of the rear end portion of the side wall 7 in such a manner that they are arranged in a T-shape or L-shape, the mounting plate 16 is easily and firmly welded to the upper end of the rear end portion of the side wall 7, and thus the mounting plate 16 is strongly fixed to the side wall 7. The inner wall 12 and the outer wall 13 of the support frame 11 can be easily and securely welded to the mounting plate 16, and the inner wall 12 and the outer wall 13 can be strongly fixed to the mounting plate 16.

Moreover, the track frame 73 of each of the right/left traveling devices 3 is configured as a component separate from the body frame 1, and is attached to the corresponding side wall 7 of the frame main body 9 using the fastener 87, such as bolt, and thus the underbody frame is provided as a component separate from the body frame 1. Therefore, when the frame is pained with two colors, masking becomes unnecessary, and such simplified handling leads to cost reduction. Specifically, in the case where the track frame 73 of each of the right/left traveling device 3 is connected and welded to the body frame 1 to form the body frame 1 and the track frame 73 in a unified manner, when it is desired that the body frame 1 and the underbody frame be painted with different colors, it is necessary to paint the body frame 1 and the track frame 73 with two different colors. This further necessitates a step of masking the frames, leading to an increase in the number of steps.

When the body frame 1 and the track frame 73 are formed in a unified manner, a weight of the entire frame becomes heavy, leading to difficulties in handling of an article as a single item and in transporting into and out of a facility. As a result, a production cost tends to be higher. However in the present application, the underbody frame can be configured as a component separate from the body frame 1, and therefore, it is possible to transport the body frame 1 and the track frame 73 separately into and out of the facility, enhancing easiness in handling of the article as a single item. Further, the step of masking for two-color paint becomes unnecessary. As a result of these, the production cost becomes suppressed.

Since each of the connecting pieces 8*b* is welded to the front end of the bent rim portion 7*a* of the corresponding side wall 7, the frame main body 9 itself can become strong by the welding.

By the partition plate 80 and the bottom wall body 58 and back wall body 51 of the cabin 4, the portions frontward of the back wall body 51 of the cabin 4 and the front portion of the body frame 1 are shielded from the rear portion of the body frame 1 on which the engine 101 is mounted. Therefore, heated air from the engine 101 in the rear portion of the body frame 1 can be surely blocked by the partition plate 80 and the bottom wall body 8 and back wall body 51 of the cabin 4. Accordingly, the heated air from the engine 101 never reach the driver in the cabin 4 who is seated on the driver's seat 63 or driver's legs or the like extending in the body frame 1, and the driver can be surely protected from the heat of the engine.

To the outside of each of the right/left side walls 7 of the body frame 1, front and rear end portions of the track frame 73 of the traveling device 3 are fixed using fasteners, such as bolt, and on the inner face of each of the right/left side walls 7 of the body frame, at positions corresponding to the position of the fixed track frame 73, the front reinforcing plate 75 and the rear reinforcing plate 76 are overlapped with and welded to the inner face. Therefore, by the front reinforcing plate 75 and the rear reinforcing plate 76, the portion of each of the right/left side walls 7 of the frame main body 9 to which the track frame 73 is fixed can be effectively reinforced. Moreover, the reinforcing plates 75,76 have the standing walls 75*a*,76*a* that overlap with the inner face of the side wall 7 and the lower walls 75*b*,76*b* that overlap with the upper face of the bottom wall 6, respectively, the standing wall and the lower wall being arranged in an L-shape. Therefore, the front reinforcing plate 75 and the rear reinforcing plate 76 themselves have enhanced stiffness, and by the front reinforcing plate 75 and the rear reinforcing plate 76, the body frame 1 can be strongly reinforced from the side wall 7 to the bottom wall 6.

Since the lower walls 75*b* of the right/left front reinforcing plates 75 are spaced apart in the transverse direction, a step is not present in a central portion in a width direction of the bottom wall 6 that may otherwise be formed by the lower wall 75*b* and block the discharge of dust, operating oil or the like, and therefore, even when dust, operating oil or the like drops on the bottom wall 6 of the frame main body 9, the dust, operating oil or the like on the bottom wall 6 can be easily discharged.

It should be noted that, in the embodiment described above, on the rear upper portion of the body frame 1, the base side of the arm 77 is supported swingably in the vertical direction through the rear first lift link 81 and the rear second lift link 82. Alternatively, instead of this, the base side of the arm 77 is directly supported swingably on the rear portion of the body frame 1, without the first lift link 81 and the second lift link 82.

Industrial Applicability

According to the present invention, the hydraulic pipe arrangement disposed from the body frame side to the arm side is not likely to be damaged, the appearance of the rear postion of the loader work machine is prevented from being deteriorated which may otherwise be caused by exposed hydraulic pipe arrangement, and the number of the clamps required for fixing the hydraulic pipe arrangement can be reduced. Accordingly, the present invention can be applied to a truck loader or the like.

What we claim is:

1. A loader work machine comprising:

a body frame including a frame main body having a bottom wall, a pair of right/left side walls and a front wall; and a pair of right/left support frame provided on rear end portions of the frame main body, each of the support frames having an inner wall and an outer wall;

a cabin mounted on the body frame;

a pair of right/left traveling devices supporting the body frame;

a pair of right/left arms disposed on right/left lateral sides of the body frame and cabin;

a working implement attached between tip end portions of the right/left arms;

hydraulic actuators provided on the tip end portions of the right/left arms and configured to actuate the working implement;

a pair of right/left first lift links provided at rear portions of the body frame for supporting base portions of the respective arms swingably in a vertical direction, each of the lift links including a link outer wall, a link inner wall, a link connection wall connecting the link outer wall and link inner wall, and an arm support portion provided at an upper free end portion thereof by providing an opening on a front side thereof between the link inner wall and the link outer wall;

a pair of right/left second lift links provided at rear portions of the body frame more frontward than the first lift links for supporting the base portions of the respective arms swingably in the vertical direction;

a pair of right/left arm cylinders extending between the base portions of the respective arms and the rear portions of the body frame for lifting and lowering the respective arms;

a first link shaft provided between the inner wall and outer wall of the support frame associated therewith for pivotally supporting a lower base portion of the first lift link associated therewith: and a first arm shaft pivotally supporting the base portion of the arm associated therewith and received by the arm support portion, wherein a tip end side of the arm is lifted and lowered frontward of the body frame, wherein the base portion of the arm is supported by the arm support portion at a position adjacent the link outer wall in a transverse direction, to form a hose accommodation space by the link inner wall and an internal side face of the base portion of the arm, and wherein a hydraulic pipe arrangement extends toward the arm to be connected to the hydraulic actuator, the hydraulic pipe arrangement extending through from inside to outside of the link inner wall and running frontward of the first arm shaft and first link shaft to be disposed in the hose accommodation space.

2. The loader work machine according to claim 1, wherein an upper portion of the hydraulic pipe arrangement is disposed along an inner face of the link inner wall, and extends along the internal side face of the arm from an upper end of the first lift link.

3. The loader work machine according to claim 1, wherein the upper free end portion of the first lift link is made wider in the transverse direction so as to bulge laterally outward of the lower base portion of the first lift link, and the base portion of the arm is disposed offset laterally outward from a base portion of the first lift link.

4. The loader work machine according to claim 1, wherein at least the upper portion of the hydraulic pipe arrangement is formed of a flexible hydraulic hose portion, a front projection is provided at an upper end portion of the link inner wall and protrudes frontward therefrom for restricting lateral sway of the hydraulic hose portion, and a clamp is provided on the inner face of the link inner wall forming the hose accommodation space, the clamp being configured to fix the hydraulic hose portion.

5. The loader work machine according to claim 1, wherein the inner wall and the outer wall are disposed laterally outward of the side wall associated therewith.

6. The loader work machine according to claim 5, further comprising a pair of right/left mounting plates, each of the mounting plates including an inner side portion fixed to a rear upper end of the side wall associated therewith, and an outer side portion protruding laterally outward from the side wall;

wherein a front lower end of the inner wall and a front lower end of the outer wall are fixed to an upper face of the outer side portion of the mounting plate.

7. The loader work machine according to claim 6, wherein each of the right/left side wall has a bent rim portion provided at an upper end thereof, the bent rim portion protruding laterally outward, the rear upper end of the side wall being gradually inclined downward as it extends rearward;

a front end portion of the mounting plate is fixed to a rear end portion of the bent rim portion, and the mounting plate is attached to the rear upper end of the side wall so that the mounting plate and the side wall form a T-shape or L-shape, and the outer side portion of the mounting plate protrudes laterally outward from the upper end of the side wall so that the bent rim portion of the side wall and the mounting plate form a fender for covering an upper side and a rear side of the traveling device associated therewith.

8. The loader work machine according to claim 7, wherein the front wall has a bent rim portion at an upper end thereof, the bent rim portion protruding rearward, right/left connecting pieces extending laterally outward from opposite lateral sides of the bent rim portion, and each of the right/left connecting pieces is fixed to a front end of the bent rim portion of the side wall associated therewith.

9. The loader work machine according to claim 5, wherein a transverse width of the cabin is larger than a spacing distance between the right/left side walls.

10. The loader work machine according to claim 5, wherein an intermediate portion on a front end side of the arm is bent inward in the transverse direction so that a transverse width between front end portions of the right/left arms becomes smaller than a transverse width between rear portions of the right/left arms, and a whole length of the arm is disposed inward of an outer end and outward of an inner end of the traveling device associated therewith.

11. The loader work machine according to claim 1, further comprising a transversal connecting member connecting upper portions of the right/left inner walls, wherein the transversal connecting member includes a front wall plate, and an upper wall plate protruding rearward from an upper end of the front wall plate, a rear portion of the upper wall plate being inclined downward and rearward.

12. The loader work machine according to claim 1, further comprising:

a connection reinforcing plate which is fixed to a rear end portion of the bottom wall along a rear end of the bottom wall and connected and fixed to lower ends of the right/left support frames; and a lower connection plate which is fixed to a rear end portion of the connection reinforcing plate along a rear end of the connection reinforcing plate and connected and fixed to the lower ends of the right/left support frames.

13. The loader work machine according to claim 1, wherein each of the right/left traveling devices includes a track frame which is a component separate from the body frame and is fixed to the side wall associated therewith.

14. The loader work machine according to claim 13, further comprising a pair of right/left reinforcing plates;

wherein each of the right/left reinforcing plates is fixed to an inner face of the side wall associated therewith at a position corresponding to a position for fixing the track frame.

15. The loader work machine according to claim 14, wherein each of the right/left reinforcing plates includes a standing wall overlapping with the inner face of the side wall and a lower wall overlapping with an upper face of the bottom wall, the standing wall and the lower wall together forming an L-shape, and the lower walls of the right/left reinforcing plates are spaced apart in the transverse direction.

16. The loader work machine according to claim 14, wherein a front end portion and a rear end portion of the track frame are fixed to an outer face of the side wall, and a front reinforcing plate and a rear reinforcing plate are fixed to the inner face of the side wall at positions corresponding to positions of the front end portion and rear end portion of the fixed track frame, respectively.

17. The loader work machine according to claim 1, wherein the cabin includes a pair of right/left side wall bodies, a back wall body closing a back side of the cabin and a bottom wall body connecting lower end portions of the right/left side wall bodies, the cabin is swingably supported on the body frame so as to be switchable between a mount state in which a bottom side of the cabin is placed on the body frame, and a tilted state in which the bottom side of the cabin is spaced apart upward from the body frame, a partition plate is provided for separating the frame main body into a front portion and a rear portion of the body frame, and a driver's seat is provided on the bottom wall body frontward of the back wall body, and when the cabin is brought to the mount state, the bottom wall body comes into contact with an upper side of the partition plate, portions frontward of the back wall body and the front portion of the body frame are shielded from the rear portion of the body frame on which an engine is mounted, by the partition plate, bottom wall body and back wall body.

* * * * *